US010759593B2

(12) United States Patent
Pohlman et al.

(10) Patent No.: US 10,759,593 B2
(45) Date of Patent: Sep. 1, 2020

(54) STACKABLE DISPLAY CONTAINERS

(71) Applicant: Inline Plastics Corp., Shelton, CT (US)

(72) Inventors: Christopher John Pohlman, West Haven, CT (US); Victor Ivenitsky, South Salem, NY (US); Nicholas Baron Ivanoff, Ansonia, CT (US); Carrie Cline, Milford, CT (US)

(73) Assignee: Inline Plastics Corp., Shelton, CT (US)

( * ) Notice: Subject to any disclaimer, the term of this patent is extended or adjusted under 35 U.S.C. 154(b) by 0 days.

(21) Appl. No.: 16/003,738

(22) Filed: Jun. 8, 2018

(65) Prior Publication Data

US 2019/0375579 A1 Dec. 12, 2019

(51) Int. Cl.

| | |
|---|---|
| ***B65D 85/62*** | (2006.01) |
| ***B65D 5/00*** | (2006.01) |
| ***B65D 21/02*** | (2006.01) |
| ***B65D 43/16*** | (2006.01) |

(52) U.S. Cl.

CPC ..... *B65D 85/62* (2013.01); *B65D 5/005* (2013.01); *B65D 21/0223* (2013.01);

(Continued)

(58) Field of Classification Search

CPC .... B65D 85/62; B65D 5/005; B65D 21/0223; B65D 43/16; B65D 2543/00101; B65D 2543/00194; B65D 2543/00296

(Continued)

(56) References Cited

U.S. PATENT DOCUMENTS

| | | | |
|---|---|---|---|
| 2,256,723 | A | 9/1941 | Irwin |
| D151,679 | S | 11/1948 | Braun |

(Continued)

FOREIGN PATENT DOCUMENTS

| | | | |
|---|---|---|---|
| CA | 149435 | S | 1/2014 |
| EP | 0380321 | A1 | 8/1990 |

(Continued)

OTHER PUBLICATIONS

Photograph of $D_6$ Inc. Marketside Sandwich Wrap container used exclusively for Walmart.

(Continued)

*Primary Examiner* — Chun Hoi Cheung
(74) *Attorney, Agent, or Firm* — McCarter & English, LLP

(57) ABSTRACT

Disclosed are display containers (e.g., for packaging food items). Certain embodiments of the container are stackable and include a cover portion of the container having a non-flat presentation surface, and one or more stacking recesses defined between the non-flat presentation surface and at least one of the one or more cover body sides. A base portion of the container can include a mating surface shaped to mate with a portion of the non-flat presentation surface when stacked on a corresponding bottom container such that an inside of the corresponding bottom container can be viewed through the non-flat presentation surface of the bottom container. The base body can include one or more stacking feet extending from the base body and configured to insert into the one or more stacking recesses when stacked on the cover portion of the corresponding bottom container such that the one or more stacking feet engage the cover portion.

11 Claims, 48 Drawing Sheets

(52) U.S. Cl.
CPC .... *B65D 43/16* (2013.01); *B65D 2543/00101* (2013.01); *B65D 2543/00194* (2013.01); *B65D 2543/00296* (2013.01)

(58) Field of Classification Search
USPC ..... 206/503, 508, 509, 511, 445; 220/4.23, 220/839
See application file for complete search history.

(56) References Cited

U.S. PATENT DOCUMENTS 2,715,458 A 8/1955 Polglase
D182,255 S 3/1958 Smith
3,029,937 A 4/1962 Vogt
3,128,030 A 4/1964 Davies
3,164,478 A 1/1965 Donald
D204,505 S 4/1966 Bostrom
D205,868 S 9/1966 Immermann
D205,968 S 10/1966 Bostrom
3,306,462 A 2/1967 Da
D208,828 S 10/1967 Braun
3,372,812 A 3/1968 Parcels
3,376,046 A 4/1968 Kivett et al.
3,390,809 A 7/1968 Giorgio
3,394,861 A 7/1968 Truax
D212,593 S 11/1968 Collie
D212,594 S 11/1968 Collie
3,410,698 A 11/1968 Sosin
3,424,342 A 1/1969 Scopp et al.
D213,310 S 2/1969 Collie
D218,155 S 7/1970 Britt
3,589,554 A 6/1971 Smith
D227,226 S 6/1973 City
3,740,238 A 6/1973 Graham
D231,089 S 4/1974 Hill
3,863,832 A 2/1975 Gordon et al.
3,876,130 A 4/1975 Haase
D236,692 S 9/1975 Haase
3,902,540 A 9/1975 Commisso
3,933,295 A 1/1976 Congleton
3,937,389 A * 2/1976 Wind ..... B65D 1/34 229/406
D240,353 S 6/1976 Edwards
D241,820 S 10/1976 Jewell
D241,821 S 10/1976 Jewell
D241,822 S 10/1976 Jewell
4,014,450 A 3/1977 Girotti et al.
D245,579 S 8/1977 Jewell
D245,762 S 9/1977 Takacs
4,079,880 A 3/1978 Edwards
4,096,986 A 6/1978 Florian
4,127,189 A 11/1978 Shumrak et al.
4,132,344 A 1/1979 Jewell
4,150,777 A 4/1979 Cyr et al.
D253,456 S 11/1979 Payne
4,183,446 A 1/1980 Davis
D254,776 S 4/1980 Edwards
D256,435 S 8/1980 Payne
D258,722 S 3/1981 Commisso et al.
4,253,600 A 3/1981 Schubert
D259,543 S 6/1981 Commisso et al.
D262,866 S 2/1982 Commisso et al.
D263,023 S 2/1982 Commisso et al.
D263,798 S 4/1982 Edwards
D267,911 S 2/1983 Long et al.
D270,708 S 9/1983 Dart
D272,971 S 3/1984 Tallon
D275,165 S 8/1984 Grusin
D277,167 S 1/1985 Dart
D279,952 S 8/1985 Daenen et al.
D280,138 S 8/1985 Bakic
D280,964 S 10/1985 Wolff
D281,048 S 10/1985 Wolff
D281,229 S 11/1985 Tyler
D282,245 S 1/1986 Yeung
D282,808 S 3/1986 Daenen et al.
4,576,330 A 3/1986 Schepp
D283,481 S 4/1986 Schmidt
D284,253 S 6/1986 Carlson
D284,254 S 6/1986 Carlson
D286,729 S 11/1986 Tzifkansky et al.
D287,545 S 1/1987 Long et al.
4,640,416 A 2/1987 Northrup et al.
4,700,842 A 10/1987 Grusin
D292,626 S 11/1987 Chevassus
4,787,527 A 11/1988 Monetti
4,787,552 A 11/1988 Natori
4,819,824 A 4/1989 Longbottom et al.
4,844,263 A 7/1989 Hadtke
4,915,251 A 4/1990 Payne
D308,826 S 6/1990 Cyr et al.
D309,105 S 7/1990 Fisher et al.
D312,781 S 12/1990 Rigby
4,976,370 A 12/1990 Cassel
5,009,312 A 4/1991 Leben
D317,569 S 6/1991 Lane, Sr.
5,046,659 A 9/1991 Warburton
D322,757 S 12/1991 Payne
5,071,060 A 12/1991 DeFelice
D323,114 S 1/1992 Sheehan
D325,847 S 5/1992 Wolff
D330,490 S 10/1992 Turner
D330,830 S 11/1992 Baranyai et al.
D330,996 S 11/1992 Smith et al.
5,169,014 A 12/1992 Hexamer
D332,204 S 1/1993 Carlson
D332,218 S 1/1993 Serna
5,176,272 A 1/1993 Ryan
D334,114 S 3/1993 Narsutis
5,259,505 A * 11/1993 Sobel ..... B65D 21/0223 206/504
D343,768 S 2/1994 Cautereels et al.
5,310,070 A 5/1994 Haas et al.
D348,394 S 7/1994 Dreyer
D348,805 S 7/1994 Cautereels
D349,050 S 7/1994 Krupa
D350,880 S 9/1994 VanValkenburg et al.
D351,090 S 10/1994 Narsutis
D353,327 S 12/1994 Castner et al.
D357,161 S 4/1995 Booten
5,405,009 A 4/1995 Hackenbracht
5,409,126 A 4/1995 DeMars
5,445,397 A 8/1995 Evans
D365,206 S 12/1995 Goodman
D365,251 S 12/1995 Lo
D366,397 S 1/1996 Zimmerman
D367,211 S 2/1996 Cautereels
D367,609 S 3/1996 Frank et al.
D372,174 S 7/1996 Arduini
D373,952 S 9/1996 Exarhos et al.
D373,953 S 9/1996 Gale
5,584,408 A 12/1996 Orkisz
D377,739 S 2/1997 Carlson
D378,039 S 2/1997 Ferris
D379,138 S 5/1997 Carlson
D380,349 S 7/1997 Indekeu
D381,560 S 7/1997 Indekeu
D382,956 S 8/1997 Collins
D384,247 S 9/1997 Smith et al.
D386,042 S 11/1997 Miller
D388,324 S 12/1997 Bonnard
D392,881 S 3/1998 Bulcher et al.
D395,985 S 7/1998 Krupa et al.
D403,176 S 12/1998 Harper
D403,924 S 1/1999 Carlson
5,862,930 A 1/1999 Orkisz
D406,233 S 3/1999 Kaplan
D407,014 S 3/1999 McCann
D408,734 S 4/1999 McCann
5,906,292 A 5/1999 Rider, Jr.
5,950,854 A 9/1999 Rider, Jr. et al.
5,954,203 A 9/1999 Marconi
D415,935 S 11/1999 Martinez
D417,077 S 11/1999 Sheu

(56) References Cited

U.S. PATENT DOCUMENTS 5,996,787 A 12/1999 Kobayashi
D418,415 S 1/2000 Hayes et al.
D418,716 S 1/2000 Haley
D420,859 S 2/2000 Loew et al.
6,054,159 A 4/2000 Manzone
D428,310 S 7/2000 Zettle et al.
D437,685 S 2/2001 Liu
D440,470 S 4/2001 Tucker et al.
6,220,442 B1 4/2001 Merrell et al.
D443,184 S 6/2001 Maxwell et al.
D445,649 S 7/2001 Maxwell et al.
D446,085 S 8/2001 Dretzka
D449,165 S 10/2001 van der Hulst
D449,495 S 10/2001 Tucker et al.
6,332,546 B1 12/2001 Hunt
D455,321 S 4/2002 Jung et al.
D458,085 S 6/2002 Kim
D458,127 S 6/2002 de Groote
D467,128 S 12/2002 Thonis et al.
D469,314 S 1/2003 Thonis et al.
D469,665 S 2/2003 Pettaweebuncha
D479,401 S 9/2003 Claypool
D479,442 S 9/2003 Bergas
D479,673 S 9/2003 Kim
D479,954 S 9/2003 Kim
D480,929 S 10/2003 Douglas
D481,910 S 11/2003 Kim
D483,622 S 12/2003 Kim
D484,367 S 12/2003 Kim
D490,278 S 5/2004 Welsh
D496,560 S 9/2004 Lerner
D502,869 S 3/2005 Clarke
D505,323 S 5/2005 Ramirez et al.
6,889,838 B2 5/2005 Meier et al.
D505,840 S 6/2005 Schultz et al.
D509,111 S 9/2005 Vovan
D509,411 S 9/2005 Laib et al.
D509,995 S 9/2005 Laib et al.
D510,804 S 10/2005 Horman
D511,942 S 11/2005 Laib et al.
D513,376 S 1/2006 Shannon
D516,801 S 3/2006 Jones, III et al.
D521,812 S 5/2006 Kim
7,073,680 B2 7/2006 Boback et al.
D526,857 S 8/2006 Littmann
D529,798 S 10/2006 Snedden et al.
D530,198 S 10/2006 Snedden et al.
D533,080 S 12/2006 Darin
D539,100 S 3/2007 Zhao
D539,666 S 4/2007 Chou
D540,192 S 4/2007 Darin
D540,666 S 4/2007 Ramirez et al.
D541,598 S 5/2007 Kim
D541,649 S 5/2007 Ramirez et al.
D544,762 S 6/2007 Zimmerman
D546,173 S 7/2007 Au
D546,632 S 7/2007 Oberloier
D546,671 S 7/2007 Cronin et al.
D547,175 S 7/2007 Berg
7,243,813 B2 7/2007 Krueger
7,243,815 B2 7/2007 Coppedge et al.
D549,119 S 8/2007 Becker
D551,515 S 9/2007 Ablo et al.
D551,546 S 9/2007 Ramirez et al.
D553,444 S 10/2007 de Groote et al.
7,284,673 B2 10/2007 Habeger et al.
D557,993 S 12/2007 Stamper et al.
D559,042 S 1/2008 de Groote et al.
D562,640 S 2/2008 Tucker et al.
D566,482 S 4/2008 Tucker et al.
D566,484 S 4/2008 George
D569,103 S 5/2008 Hoge et al.
D571,654 S 6/2008 Maroofian et al.
D573,409 S 7/2008 Lovett
D588,451 S 3/2009 Snedden et al.
D589,342 S 3/2009 Maslowski
D592,399 S 5/2009 Sage
7,568,589 B2 8/2009 Vovan
D601,014 S 9/2009 Petitjean
D602,352 S 10/2009 Pendergrass et al.
7,712,626 B2 5/2010 Vovan
D618,998 S 7/2010 Pendergrass et al.
D620,350 S 7/2010 Hernandez
D623,052 S 9/2010 Giraud et al.
D625,995 S 10/2010 Vovan et al.
D628,474 S 12/2010 Snedden et al.
D640,130 S 6/2011 Golota et al.
D647,807 S 11/2011 Golota et al.
D648,624 S 11/2011 Golota et al.
D648,625 S 11/2011 Golota et al.
D649,838 S 12/2011 Stamper et al.
D651,922 S 1/2012 Short et al.
D653,963 S 2/2012 Golota et al.
D657,237 S 4/2012 Allers et al.
D663,633 S 7/2012 Rivera et al.
8,215,485 B2 * 7/2012 Maroofian ..... B65D 75/24 206/445
D664,841 S 8/2012 Allers et al.
D665,677 S 8/2012 Wu
D668,536 S 10/2012 Sanfilippo
D672,644 S 12/2012 Allers et al.
D676,740 S 2/2013 Golota et al.
D680,860 S 4/2013 Schulter et al.
D681,446 S 5/2013 Schulter et al.
8,567,604 B2 * 10/2013 Overgaad ..... B65D 21/022 206/508
D701,456 S 3/2014 Farley et al.
D708,940 S 7/2014 Juna et al.
D708,941 S 7/2014 Das
D717,161 S 11/2014 Liu
D720,987 S 1/2015 Wichowski
D728,360 S 5/2015 Kelly
D728,361 S 5/2015 Farley et al.
D728,362 S 5/2015 Kelly
D735,573 S 8/2015 Jondal et al.
D739,228 S 9/2015 Jondal et al.
D764,907 S 8/2016 Das et al.
2001/0002268 A1 5/2001 Hanson et al.
2003/0047474 A1 3/2003 Dahlson
2003/0062365 A1 * 4/2003 Krueger ..... B65D 21/0219 220/4.24
2003/0192808 A1 10/2003 Clarizio et al.
2006/0138020 A1 6/2006 Hubbs et al.
2006/0144744 A1 7/2006 Rodriquez et al.
2006/0186014 A1 * 8/2006 Ramanujam ..... B65D 21/0223 206/508
2006/0219593 A1 * 10/2006 Linz ..... B65D 21/0223 206/509
2006/0237454 A1 * 10/2006 Clarke ..... B65D 75/22 220/4.21
2006/0289549 A1 12/2006 Vovan
2007/0095695 A1 5/2007 Smith
2008/0020120 A1 1/2008 O'Donnell Kiely
2008/0305218 A1 12/2008 Kahn
2009/0134209 A1 5/2009 Tonaltzin
2009/0206082 A1 8/2009 Vovan
2009/0211941 A1 * 8/2009 Maroofian ..... B65D 75/24 206/776
2010/0155402 A1 6/2010 Maroofian et al.
2011/0215097 A1 9/2011 Archie, Jr. et al.

FOREIGN PATENT DOCUMENTS

EP 0420429 B1 11/1994
GB 2195318 B 10/1990

OTHER PUBLICATIONS

Pactiv Product for 12 Inch Cookie Container Product; http://www.pactiv.com/pactiv/products/12x8h37524cc.
D&W Fine Pack LLC Product Literature Brochure for Deli Containers, printed in 2017.

(56) References Cited

OTHER PUBLICATIONS

Placon Crystal Seal refresh product containers https://www.placon.com/news/new-recycled-post-consumer-pet-thermoformed-food-containers-put-spotlight-fresh-grab-go-foods/, accessed Sep. 28, 2017.
Placon Crystal Seal refresh Tamper-Evident Tall Clear Angled Container Product Literature; https://www.placon.com/products/stock-food-package/crystal-seal-refresh-tamper-evident-tall-clear-angled-container/, accessed Sep. 28, 2017.
Placon Product Literature for tamper-evident rigid thermoformed Bakery & Deli containers, printed in 2017.
EcoStar Product Literature for RPET-F extruded PET food packaging.
Sunzza brand Product Literature for BOPS disposable locking clamshell sandwich box for sale on Alibaba.com (web link no longer active).
U.S. Appl. No. 29/650,742, filed Jun. 8, 2018.

* cited by examiner

SECTION B-B

SECTION A-A

DETAIL F

SECTION A-A

DETAIL D

STACKABLE DISPLAY CONTAINERS

BACKGROUND OF THE DISCLOSURE

1. Field of the Disclosure

This disclosure generally relates to containers, e.g., for food items, and more particularly to plastic containers that are adapted and configured to be displayed in a stacked arrangement.

2. Background of the Related Art

Traditional containers, e.g., for food items sold at stores, are limited in their ability to display the contents therein while being stacked. Moreover, existing containers are unstable if stacked on an angled shelf, e.g., as in certain sandwich containers, and also risk damaging the label when stacked. Improved containers are desired.

SUMMARY OF THE DISCLOSURE

The purpose and advantages of one or more embodiments of this disclosure will be set forth in and apparent from the description that follows. Additional advantages of one or more embodiments of this disclosure will be realized and attained by the devices, systems and methods particularly pointed out in the written description and claims hereof, as well as from the appended drawings.

To achieve these and other advantages and in accordance with the purpose of one or more embodiments of this disclosure, as embodied, one or more embodiments include, in at least one aspect, a stackable display container (e.g., for packaging food items such as sandwiches). Certain embodiments of the container include a cover portion including a cover sealing interface and a cover body extending from the cover sealing interface. The cover body can include a non-flat presentation surface, one or more cover body sides connecting the non-flat presentation surface to the cover sealing interface, and one or more stacking recesses defined in the container body (e.g., between the non-flat presentation surface and at least one of the one or more cover body sides in certain embodiments).

A base portion can include a base sealing interface configured to mate with the cover sealing interface, and a base body extending from the base sealing interface. The base body can include a mating surface shaped to mate with the first portion of the non-flat presentation surface of the cover portion (e.g., such that when stacked on the second corresponding container, an inside of the second corresponding container can be viewed through the non-flat presentation surface of the second corresponding container). The base body can include one or more base body sides connecting the mating surface to the base sealing interface, and one or more stacking feet extending from the base body and arranged and configured to insert into the one or more stacking recesses of the second corresponding container when the container is stacked on the second corresponding container.

In certain embodiments, the base body can define a deep portion and a shallow portion such that a sitting contact plane (i.e., defined by contact points of the base portion when sitting on a flat surface) and a lip plane (e.g., defined by the base sealing interface) are non-parallel such that the base sealing interface is angled forward when the base body is resting on a flat surface. This, in turn, angles the cover body forward when the cover sealing interface and the base sealing interface are mated (e.g., to present the presentation surface and to allow viewing of the inside of the bottom container when stacked).

The container can include a living hinge connecting the cover portion to the base portion. In certain embodiments, the living hinge can include at least one score line or line of weakness.

The one or more recesses can include two or more grooves defined on opposite cover body sides, and the stacking feet can include two or more stacking feet. The non-flat presentation surface can include a curved portion defining a peak and a flat portion extending from the curved portion. The grooves can be defined at the peak. The two or more stacking feet can each include an inwardly extending ridge that snap fits and/or locks with each groove.

In certain embodiments, the one or more recesses can include two or more recesses. Each recess is defined on a corner of the cover body such that the two or more recesses wrap around a respective corner. In such embodiments, each of the stacking feet can be defined at a corner of the base body.

In certain embodiments, the one or more recesses include a single recess, and the one or more stacking feet include a single stacking foot.

The mating surface can be shaped to mate flushly with the presentation surface. Any other suitable shape is contemplated herein to allow stacking and viewing, for example.

In accordance with at least one aspect of this disclosure, a display container can include a cover portion of the container having a cover sealing interface and a cover body extending from the cover sealing interface, the cover body having a non-flat presentation surface, one or more cover body sides connecting the non-flat presentation surface to the cover sealing interface. The container can include a base portion of the container including a base sealing interface configured to mate with the cover sealing interface, and a base body extending from the base sealing interface, the base body having a mating surface shaped to mate with a portion of the non-flat presentation surface when stacked on a corresponding bottom container such that an inside of the corresponding bottom container can be viewed through the non-flat presentation surface of the bottom container, and one or more base body sides connecting the mating surface to the base sealing interface.

The base body can define a deep portion and a shallow portion such that a sitting contact plane, defined by contact points of the base portion when sitting on a flat surface, and a lip plane defined by the base sealing interface are non-parallel such that the base sealing interface is angled forward when the base body is resting on a flat surface, which angles the cover body forward when the cover sealing interface and the base sealing interface are mated to present the presentation surface and to allow viewing of the inside of the bottom container when stacked. A living hinge as described herein can connect the cover portion to the base portion. The living hinge can be defined adjacent the shallow portion of the base portion along at least a partial width of the cover sealing interface and base sealing interface.

In certain embodiments, the container can be configured to be stable in two positions (e.g., such that it can stand on a side or sit mating surface down). The container can include any other features and/or combinations thereof as disclosed herein or as appreciated by those having ordinary skill in the art.

BRIEF DESCRIPTION OF THE DRAWINGS

So that those having ordinary skill in the art to which the present invention pertains will more readily understand how to employ the subject of this disclosure, embodiments will be described in detail hereinbelow with reference to the drawings, wherein:

FIG. 2O illustrates a perspective view of the stacked container embodiments of FIG. 2J;

These and other aspects of the subject disclosure will become more readily apparent to those having ordinary skill in the art from the following detailed description of one or more embodiments of this disclosure taken in conjunction with the drawings.

DETAILED DESCRIPTION OF CERTAIN EMBODIMENTS

Embodiments of this disclosure are now described more fully with reference to the accompanying drawings, in which illustrated embodiments are shown. This disclosure is not limited in any way to the illustrated embodiments as the description below is merely provides exemplary embodiments in various forms, as appreciated by one skilled in the art. Therefore, it is to be understood that any structural and functional details disclosed herein are not to be interpreted as limiting, but merely as a basis for the claims and as a representative for teaching one skilled in the art to variously employ the embodiments disclosed herein. Furthermore, the terms and phrases used herein are not intended to be limiting but rather to provide an understandable description of the embodiments herein.

Figure 1A:
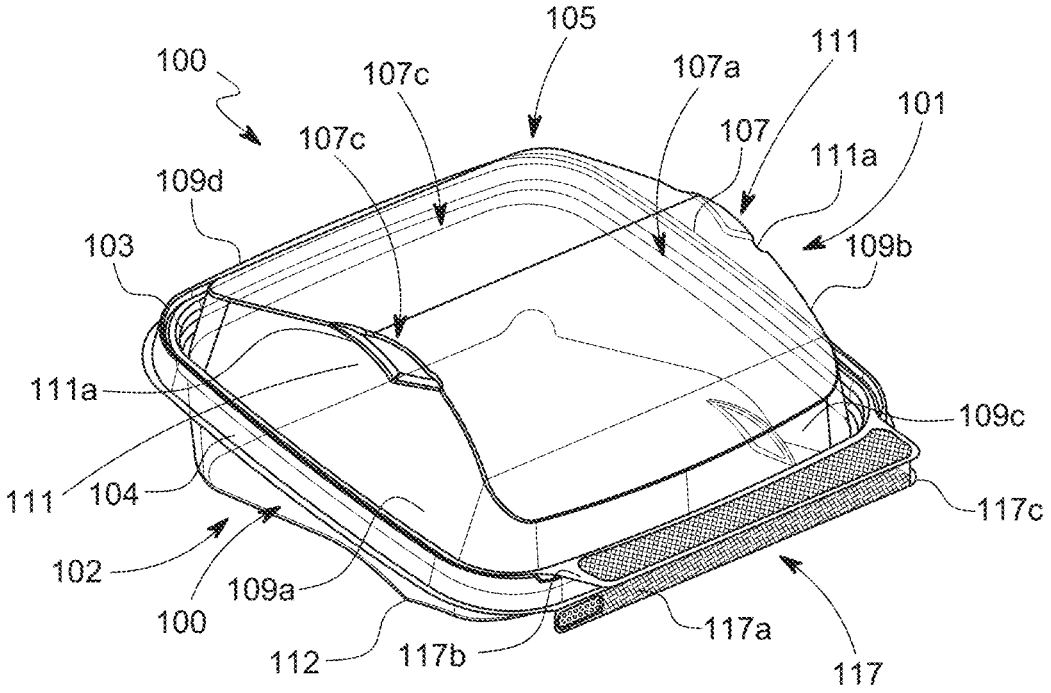
FIG. 1A illustrates a perspective view of an embodiment of a container that has been constructed in accordance with this disclosure, shown in a closed state and in a display orientation.
Figure 2A:
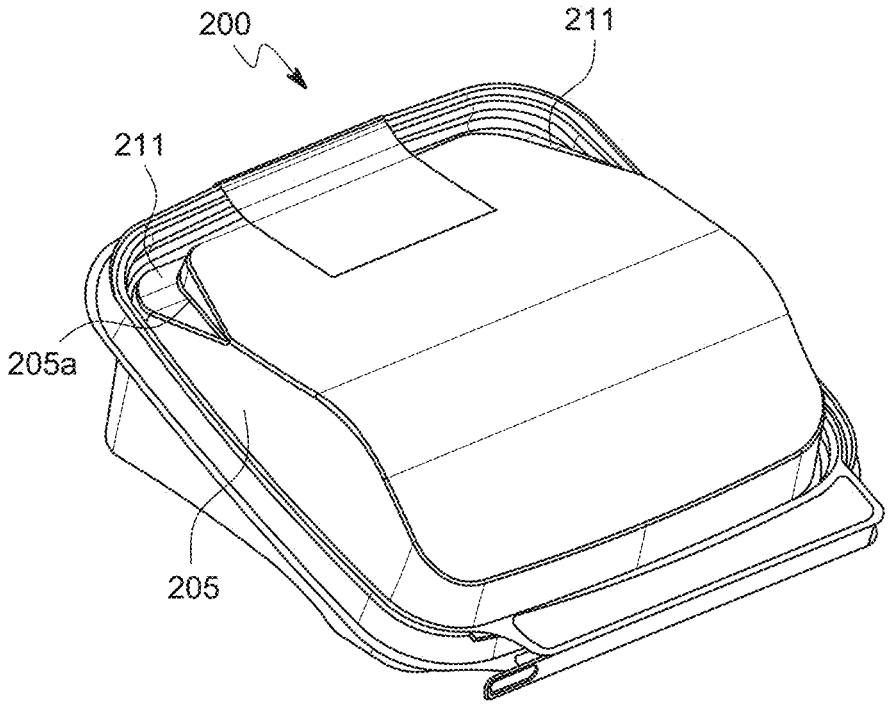
FIG. 2A illustrates a perspective view of another embodiment that has been constructed in accordance with this disclosure, shown having a label disposed thereon.
Figure 2Q:
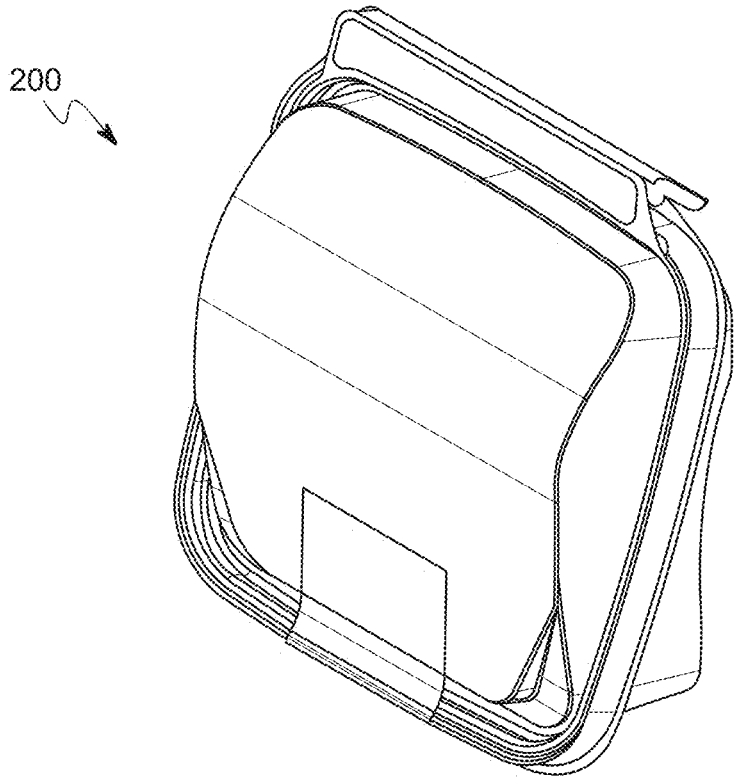
FIG. 2Q illustrates a perspective view of the container embodiment of FIG. 2A, shown in a standing position.
Figure 3A:
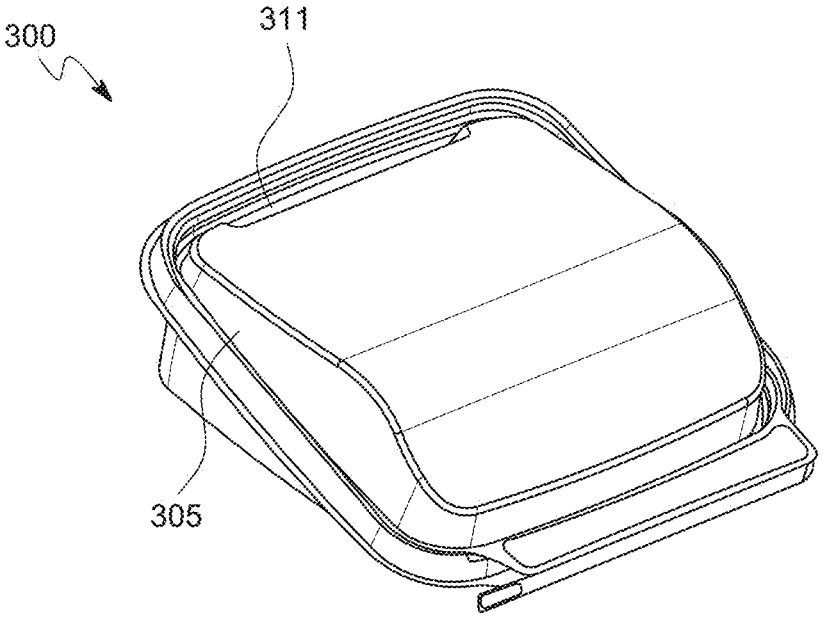
FIG. 3A illustrates a perspective view of another embodiment that has been constructed in accordance with this disclosure, shown having a label disposed thereon.
Figure 3B:
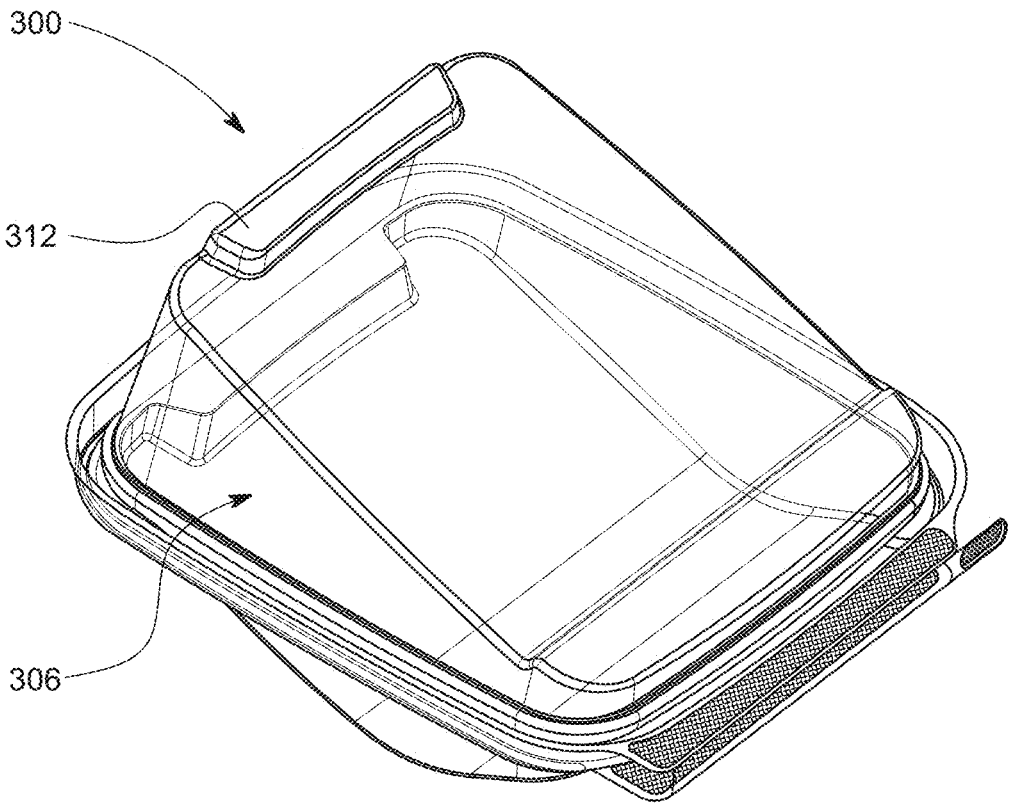
FIG. 3B illustrates a perspective view taken from below of the container embodiment of FIG. 3A, showing the base portion and in a closed state.
Figure 3C:
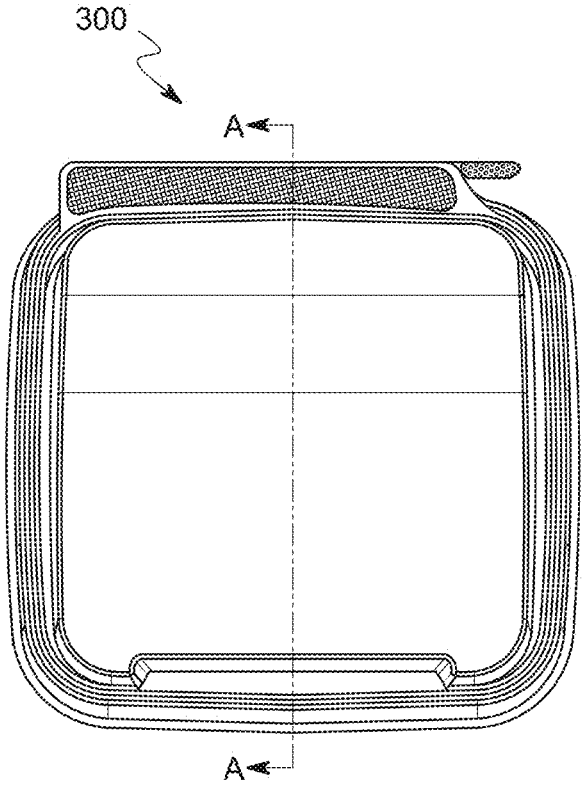
FIG. 3C illustrates a top down view of the container embodiment of FIG. 3A.
Figure 3D:
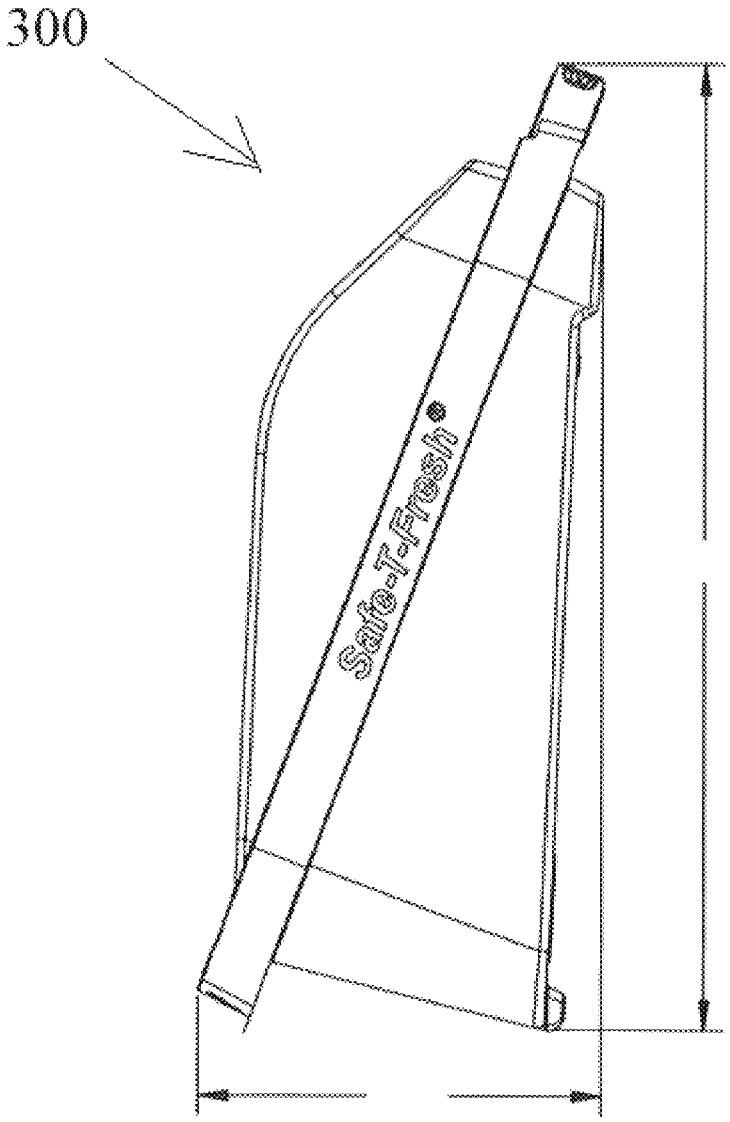
FIG. 3D illustrates a side elevation view of the container embodiment of FIG. 3A.
Figure 3E:
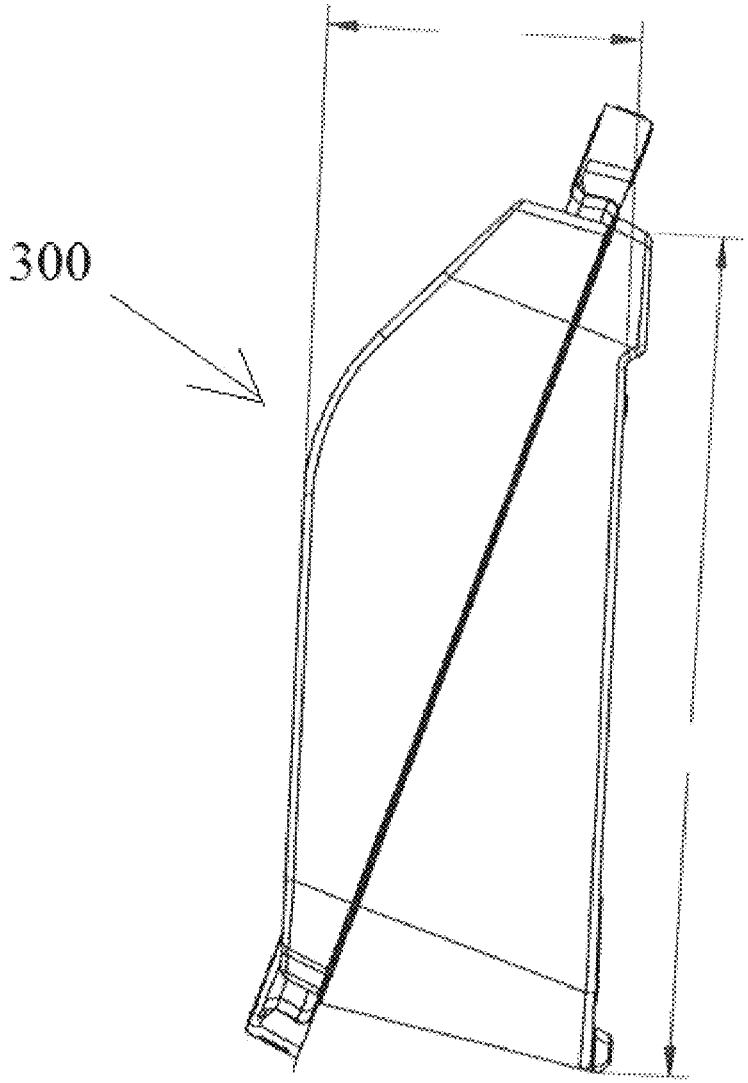
FIG. 3E illustrates a cross-sectional view of the container embodiment of FIG. 3C taken along cut line A-A.
Figure 3F:
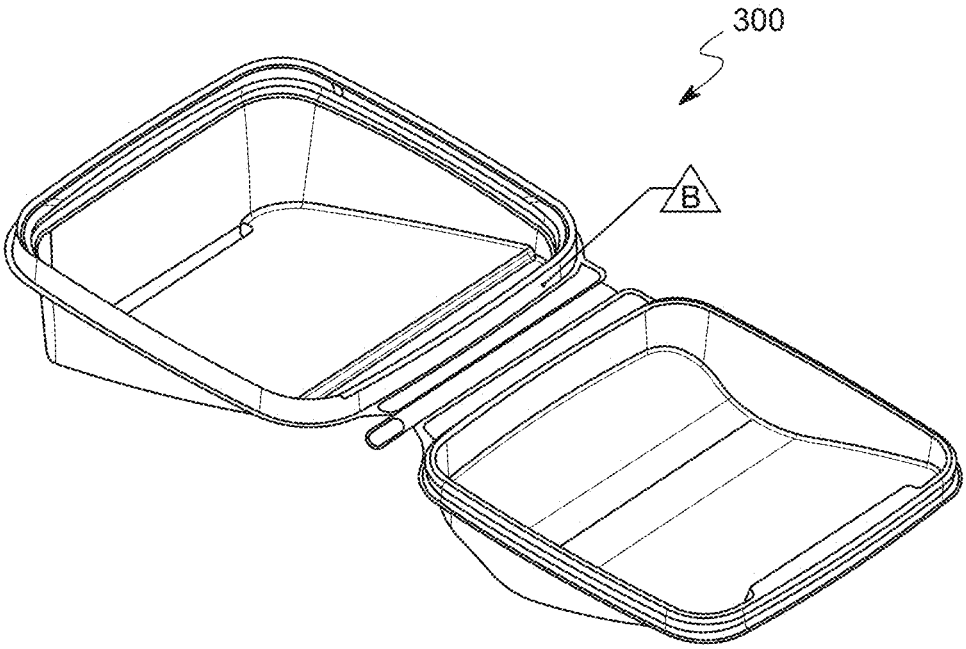
FIG. 3F illustrates a perspective view of the container embodiment of FIG. 3A, shown in an open state.
Figure 3G:
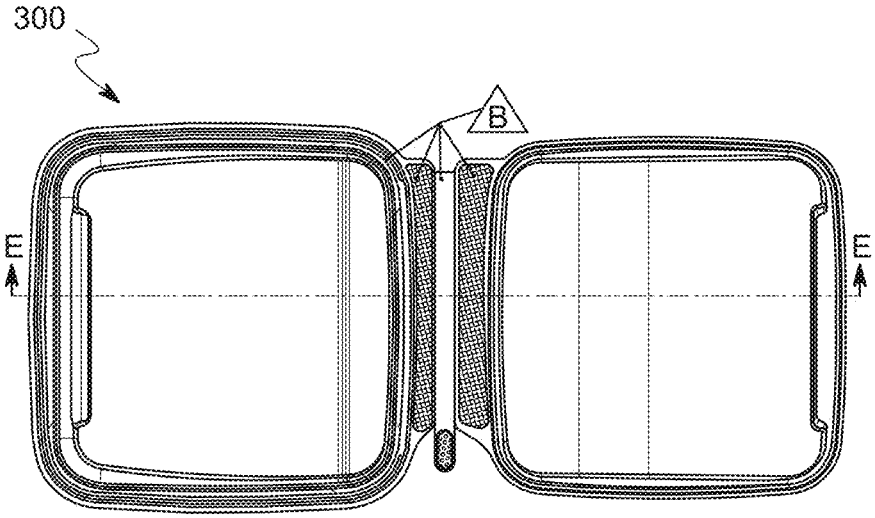
FIG. 3G illustrates a top down view of the container embodiment of FIG. 3F.
Figure 3H:
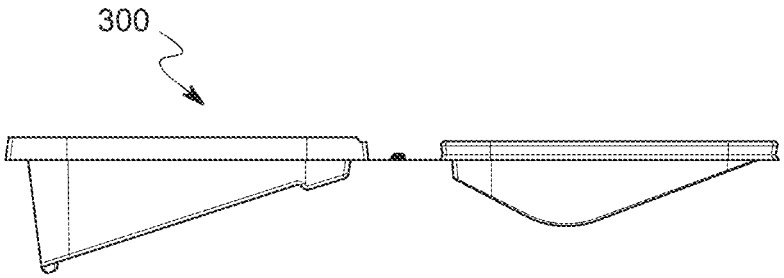
FIG. 3H illustrates a side elevation view of the container embodiment of FIG. 3F.
Figure 3I:
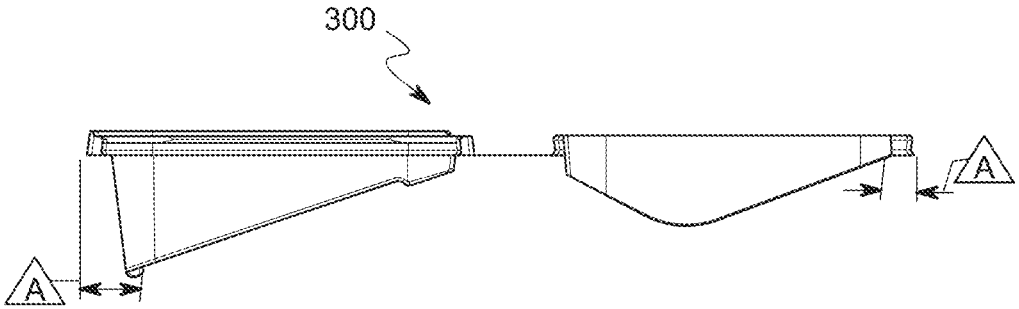
FIG. 3I illustrates a cross-sectional view of the container embodiment of FIG. 3G taken along cut line E-E.
Figure 3J:
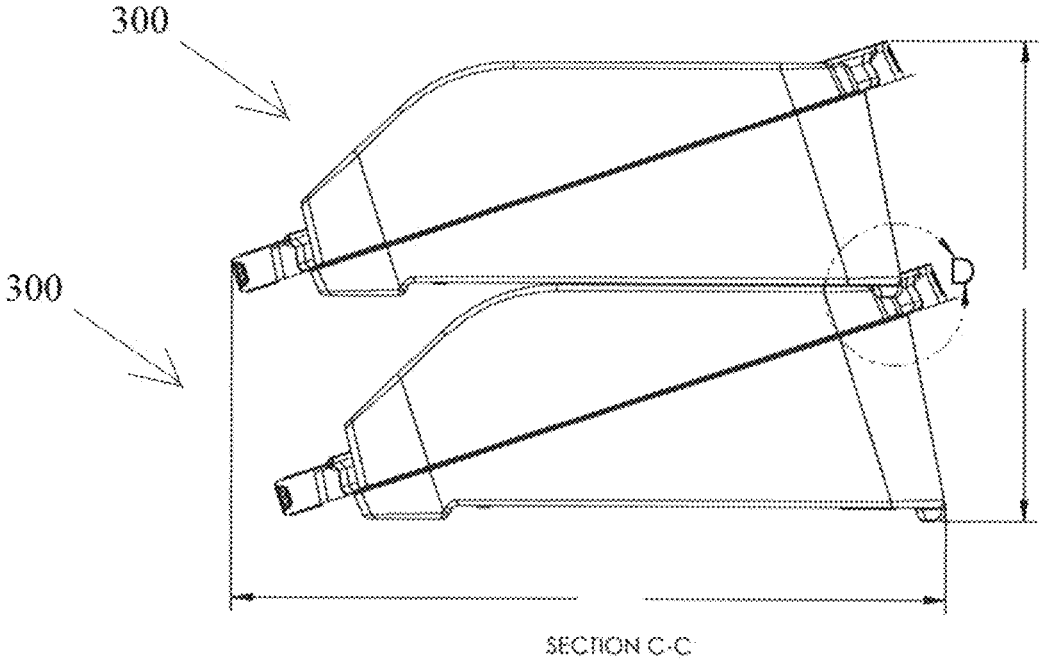
FIG. 3J illustrates cross-sectional view of two containers of the container embodiment of FIG. 3A arranged in a stacked configuration, showing a first container stacked on a corresponding second container.
Figure 3K:
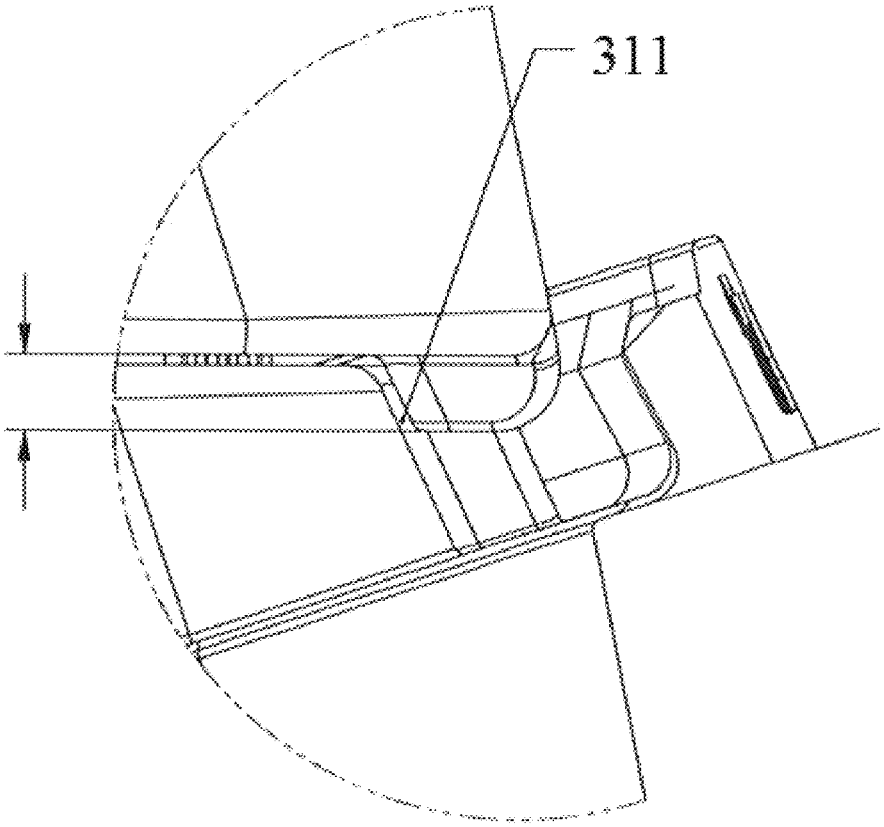
FIG. 3K illustrates an enlarged view of the container embodiment of FIG. 3J, showing a stacking foot of the first container interlocking with an recess of the second container.
Figure 3L:
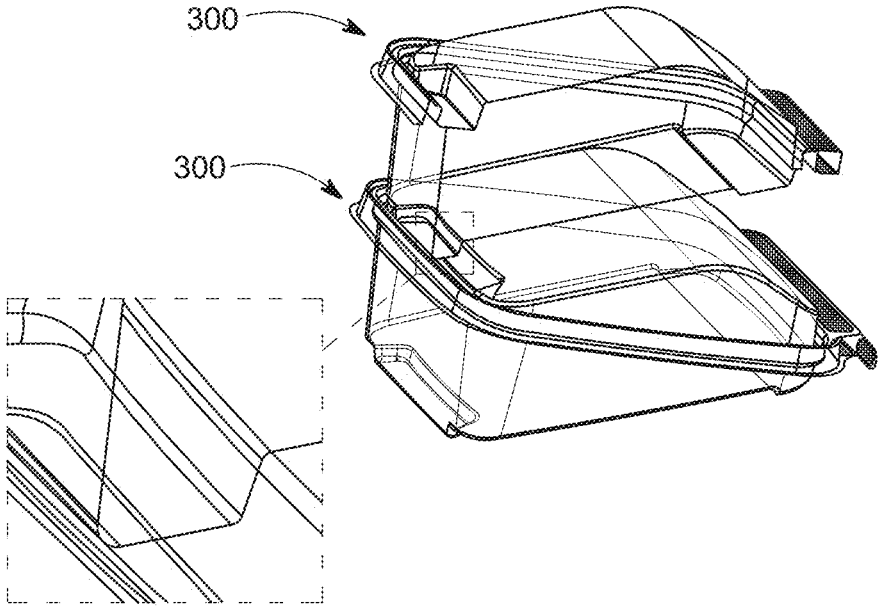
FIG. 3L illustrates a partial cross-section view of the container embodiment of FIG. 3J, showing the first/top container sectioned and showing an enlarged view of the interlocking between the first container and the second/bottom container.
Figure 3M:
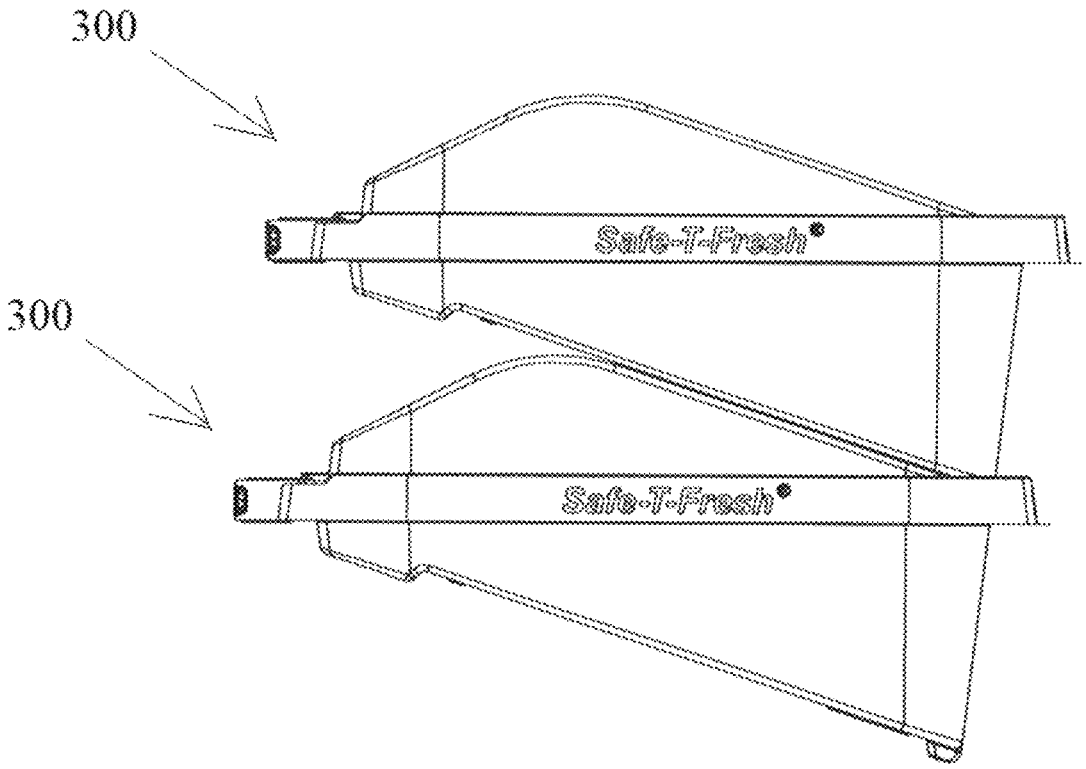
FIG. 3M illustrates a side elevation view of the container embodiment of FIG. 3J.
Figure 3N:
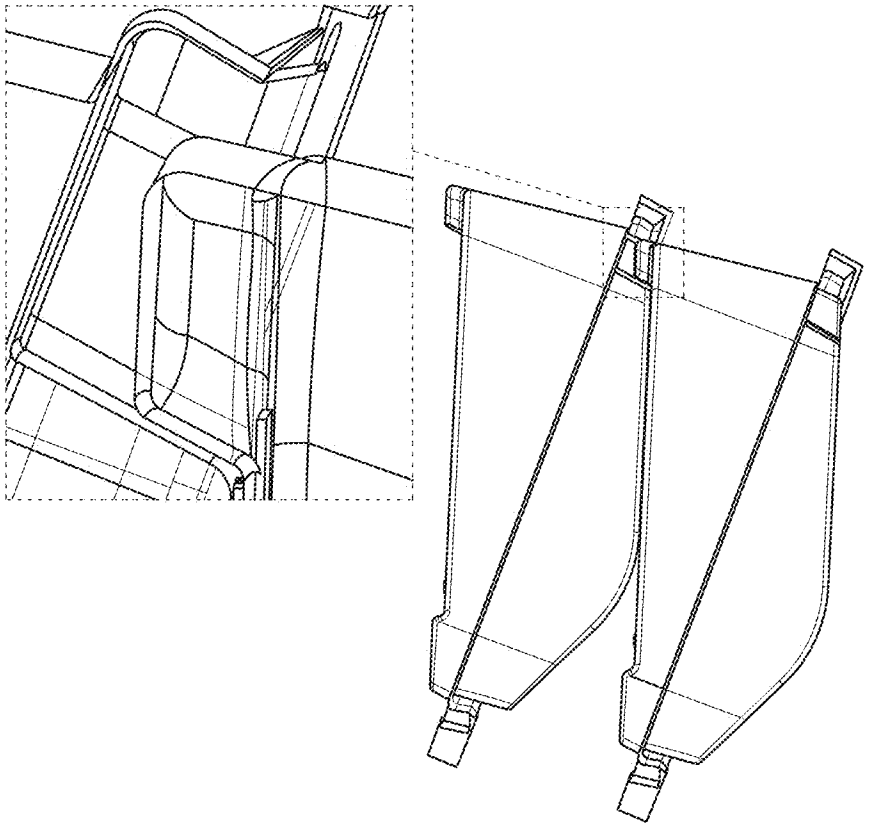
FIG. 3N illustrates a perspective and zoomed view of the container embodiment of FIG. 3M, showing interlocking of the top and second containers.
Figure 3O:
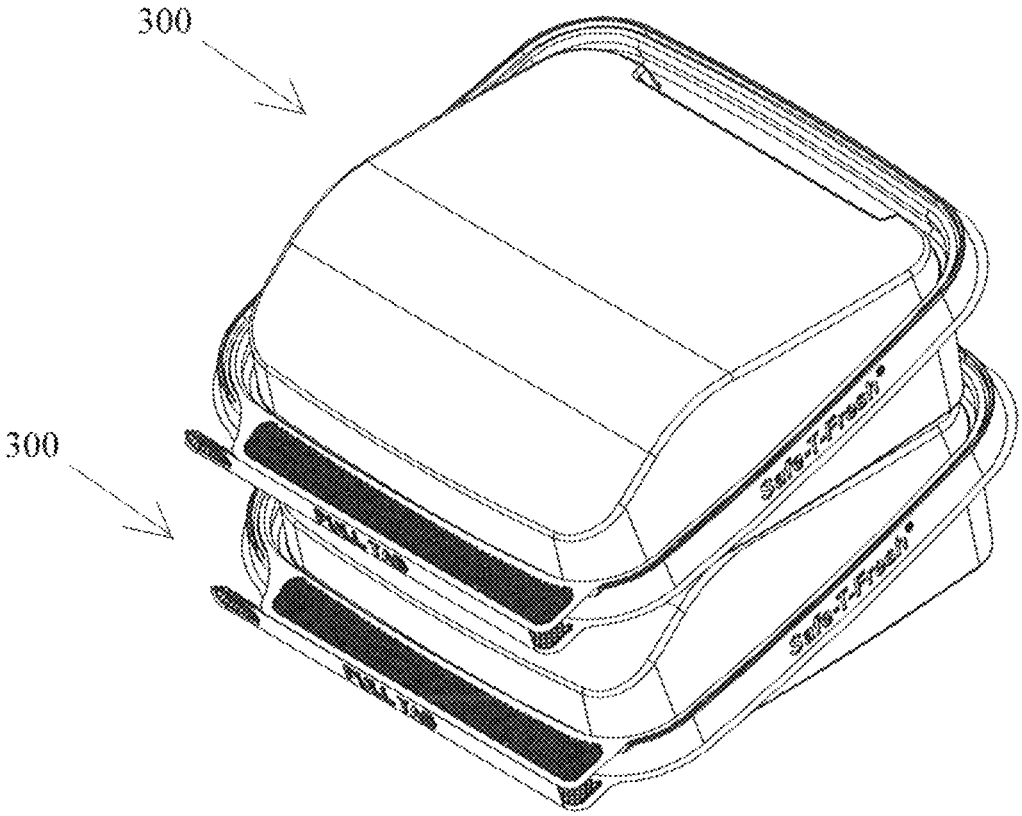
FIG. 3O illustrates a perspective view of the stacked container embodiments of FIG. 3J.
Figure 3P:
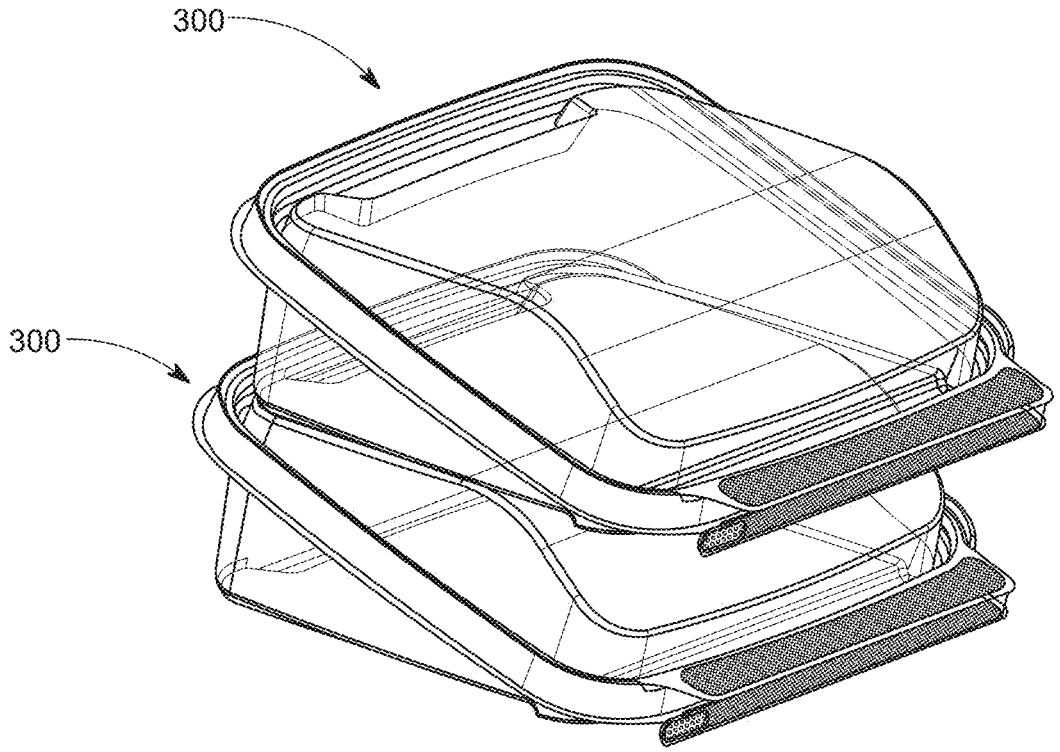
FIG. 3P illustrates a perspective view of the container embodiment of FIG. 3A, shown in a sitting position and stacked.
Figure 3Q:
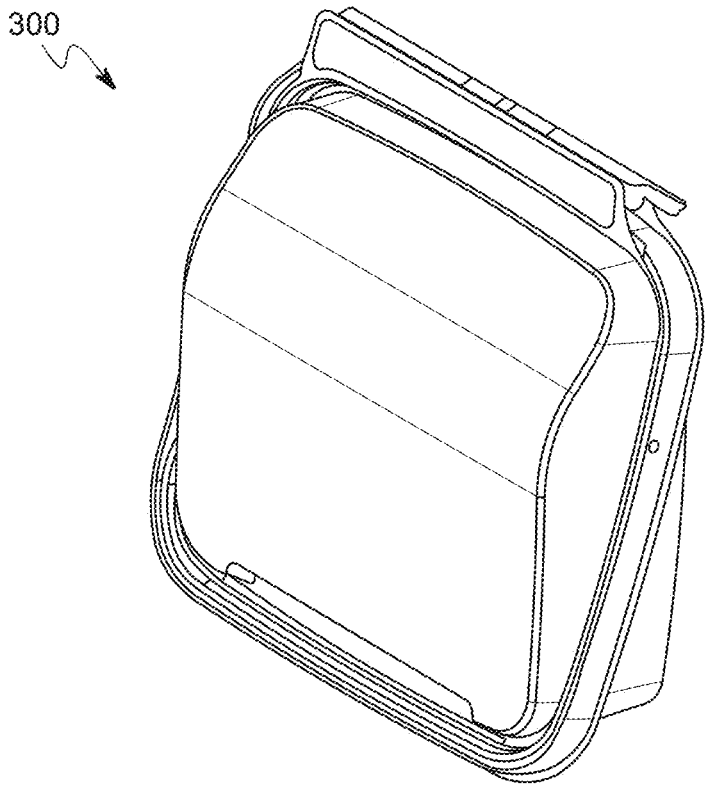
FIG. 3Q illustrates a perspective view of the container embodiment of FIG. 3A, shown in a standing position.

The present disclosure generally relates to containers (e.g., for packaging food items). Certain non-limiting embodiments of containers are described herein. Turning now descriptively to the drawings, in which similar reference characters denote similar elements throughout the several views, FIGS. 1A-1Q depict an embodiment of a stackable display container (e.g., for packaging food items). FIGS. 2A-2Q depict another embodiment of a stackable display container (e.g., for packaging food items). FIGS. 3A-3Q depict another embodiment of a stackable display container (e.g., for packaging food items). FIGS. 4A-4M depict another embodiment of a display container (e.g., for packaging food items).

While certain drawings are shown as opaque, the embodiments described herein are at least partially clear and opaque drawings are intended for clarity to show various features of the embodiments. However, it is contemplated that any suitable material (e.g., plastic) having any suitable properties (e.g., opaque, partially opaque, completely clear) can be used as appreciated by those having ordinary skill in the art.

While certain drawings may indicate certain example dimensions, any suitable dimensions for embodiments described herein or otherwise are contemplated herein. The example dimensions shown may be in inches or any other suitable scale. Any angles shown in the drawings are also for example only and any suitable angles depicted can be changed to any other suitable angle.

Also, while certain drawings may show indicia on or formed as part of embodiments of a container, any indicia is merely an example and any indicia need not be included, can be added, or can be changed in any suitable manner. Moreover, any shown use of a trademark (e.g., the term Safe-T-Fresh®) is as an indicator of source (namely the applicant) and is not to be construed that the mark is descriptive of the goods shown. All rights in any trademarks are reserved.

Referring generally to FIGS. 1A-1Q, with attention to FIG. 1A, the container 100 can include a cover portion 101 of the container 100 including a cover sealing interface 103 and a cover body 105 extending from the cover sealing interface 103. The cover body 105 can include a non-flat presentation surface 107 and one or more cover body sides 109*a, b, c, d* connecting (e.g., integrally) the non-flat presentation surface 107 to the cover sealing interface 103. In certain embodiments, the non-flat presentation surface 107 is continuous such that the non-flat presentation surface 107 does not include an edge (e.g., except where the non-flat presentation surface 107 meets the cover body sides 109*a, b, c, d*).

While embodiments shown include one or more cover body sides 109*a, b, c, d*, delineated by an edge, it is contemplated that one or more (e.g., all) of the sides 109*a, b, c, d* may be smoothly connected to and/or part of the presentation surface 107 such that the non-flat presentation surface 107 is a continuous surface to the cover sealing interface 103. For example, the front side 109*c* can be a smooth extension of the non-flat presentation surface 107 instead of having an edge as shown. In certain embodiments, the lateral sides 109*a*, 109*b* can be a smooth, laterally angled extension of the non-flat presentation surface 107. Also, as shown, the one or more cover sides 109*a, b, c, d* can be smoothly connected in any suitable manner (e.g., via rounded corners).

Certain embodiments can include one or more stacking recesses defined in the cover portion. For example, the container 100 can include one or more stacking recesses 111 defined between the non-flat presentation surface 107 and at least one of the one or more cover body sides 109*a, b, c, d*. For example, the one or more stacking recesses 111 can be defined at one or more edges between the non-flat presentation surface 107 and the cover body 109*a, b, c, d*.

A base portion 102 of the container 100 can include a base sealing interface 104 configured to mate with the cover sealing interface 103, and a base body 106 extending from the base sealing interface 104. In certain embodiments, the base sealing interface 104 can be larger than the cover sealing interface 103 to allow the cover sealing interface 103 to be inserted within the base sealing interface 104, or vice versa, to allow closure of the container. In certain embodiments, the base sealing interface 104 and the cover sealing interface 103 can include one or more interlocking features (e.g., one or more ridges to allow the base sealing interface 104 and the cover sealing interface 103 to removably interlock) as appreciated by those having ordinary skill in the art. The base sealing interface 104 and the cover sealing interface 103 can be shaped and configured to form a seal (e.g., a substantially air tight seal for food storage).

Figure 1B:
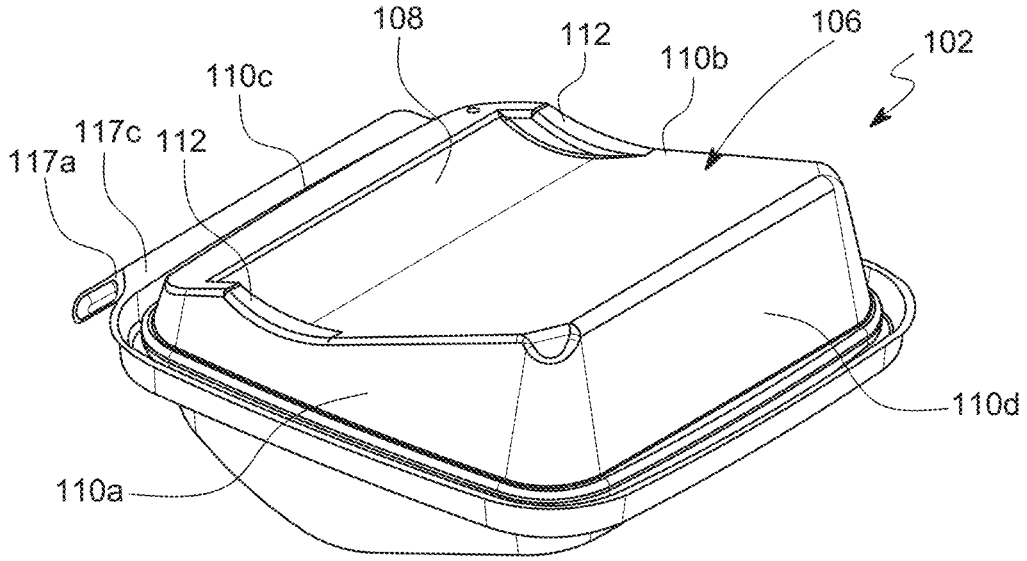
FIG. 1B illustrates a perspective view taken from below taken from below of the container embodiment of FIG. 1A, showing the base portion and in a closed state.
Figure 1C:
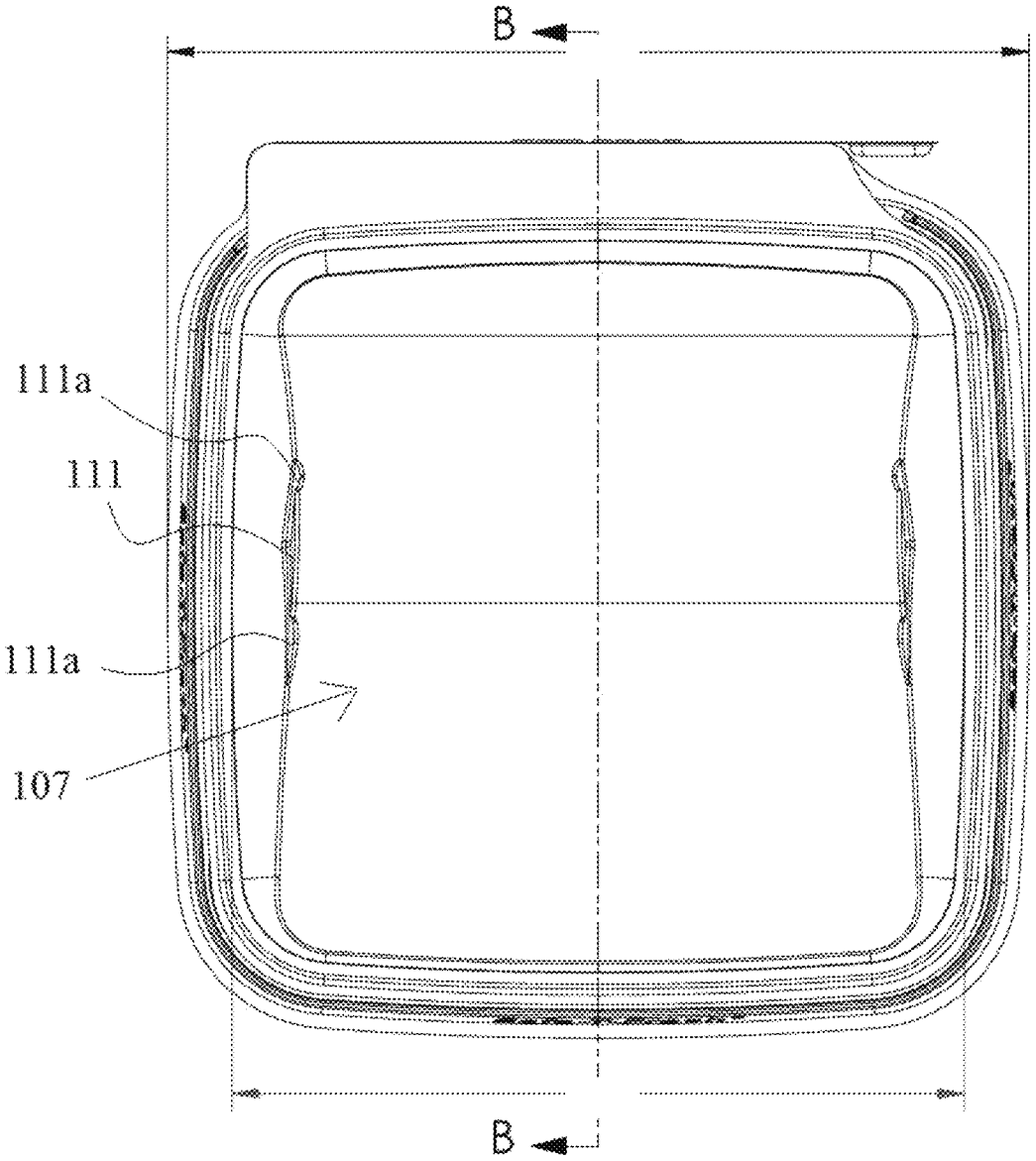
FIG. 1C illustrates a top down view of the container embodiment of FIG. 1A.
Figure 1D:
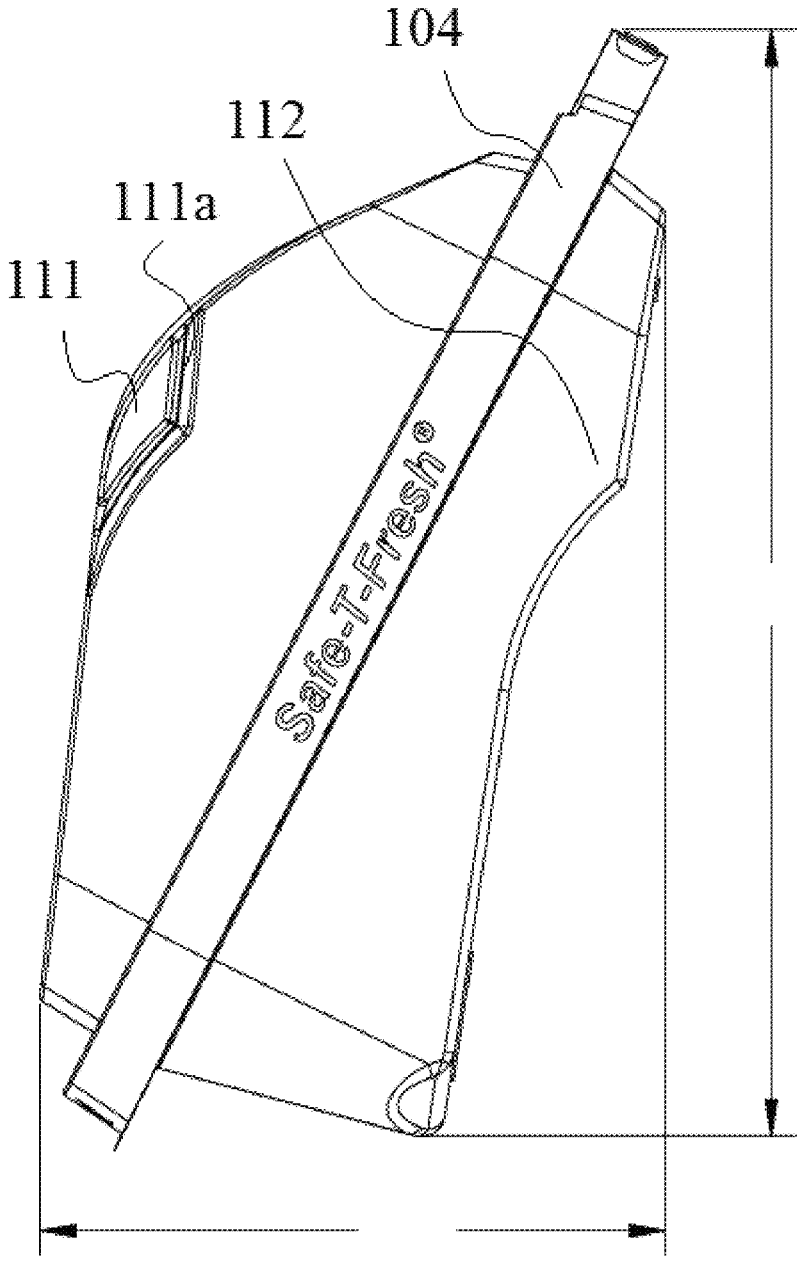
FIG. 1D illustrates a side elevation view of the container embodiment of FIG. 1A.
Figure 1E:
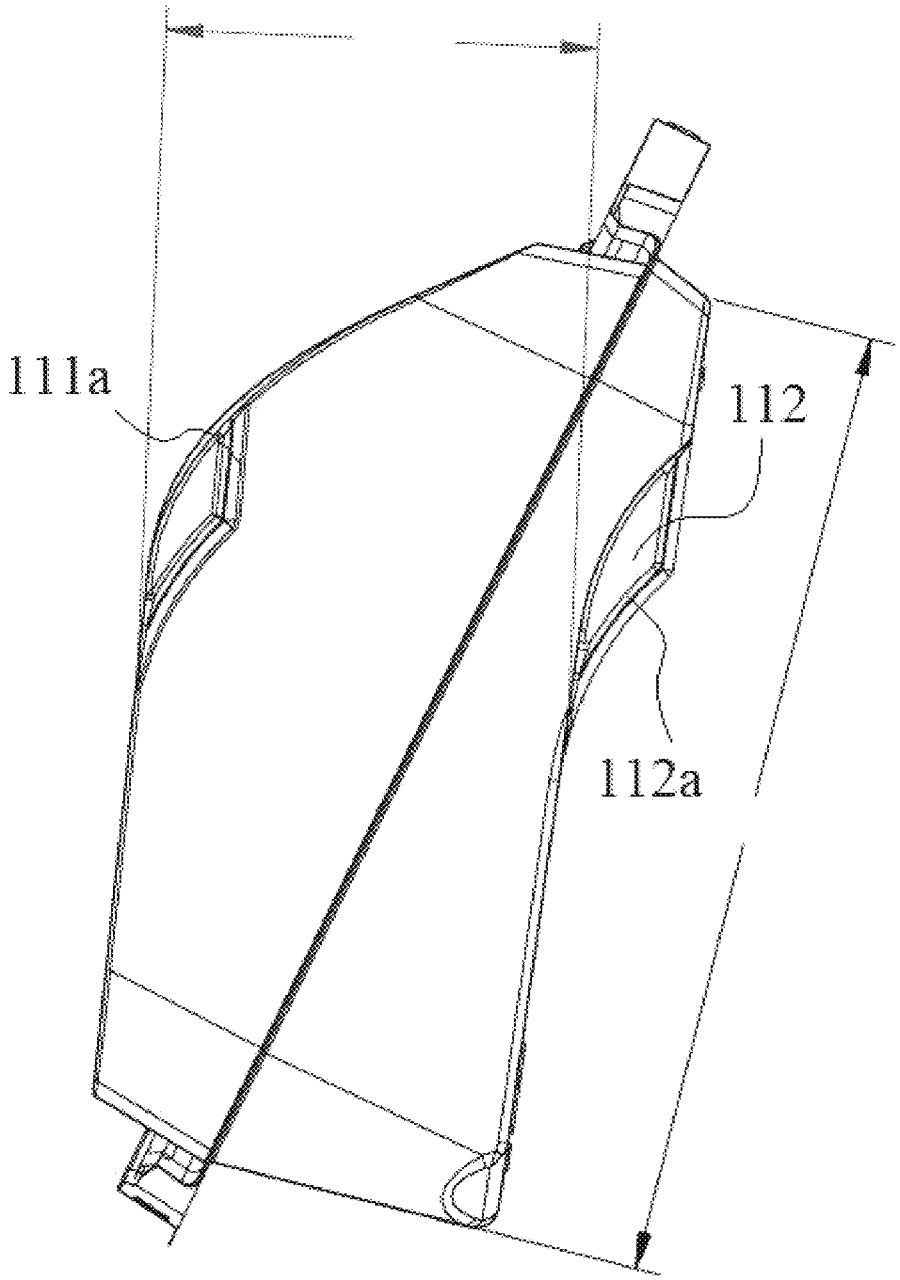
FIG. 1E illustrates a cross-sectional view of the container embodiment of FIG. 1C taken along cut line B-B.
Figure 1F:
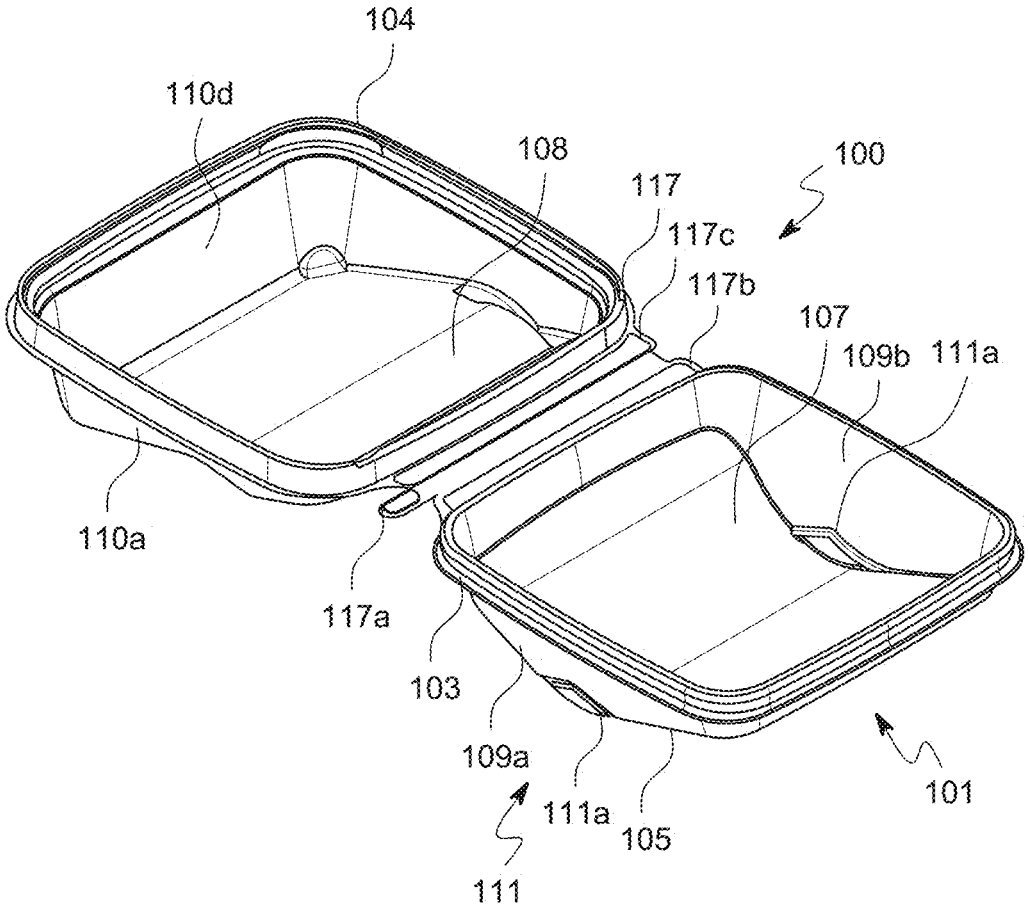
FIG. 1F illustrates a perspective view of the container embodiment of FIG. 1A, shown in an open state.
Figure 1G:
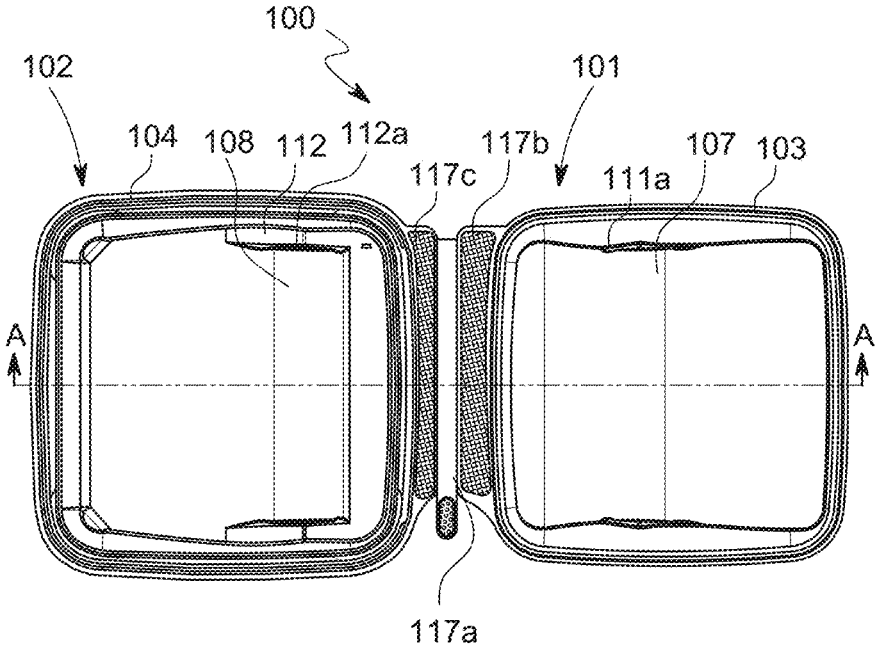
FIG. 1G illustrates a top down view of the container embodiment of FIG. 1F.
Figure 1H:
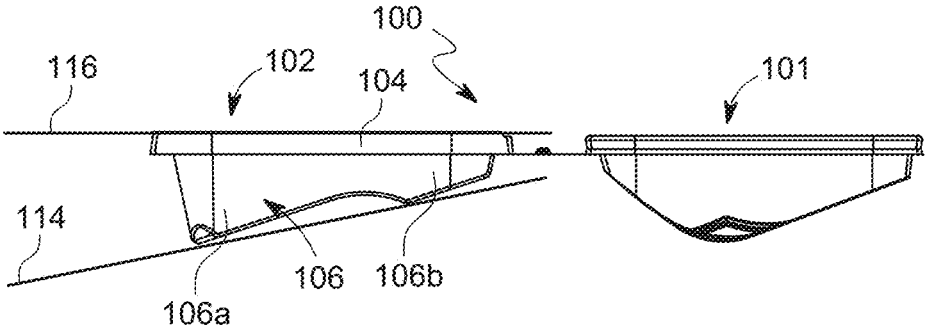
FIG. 1H illustrates a side elevation view of the container embodiment of FIG. 1F.
Figure 1I:
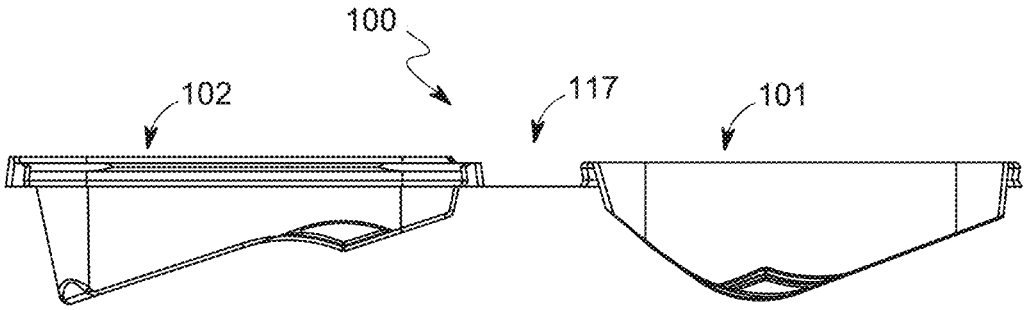
FIG. 1I illustrates a cross-sectional view of the container embodiment of FIG. 1G taken along cut line A-A.
Figure 1J:
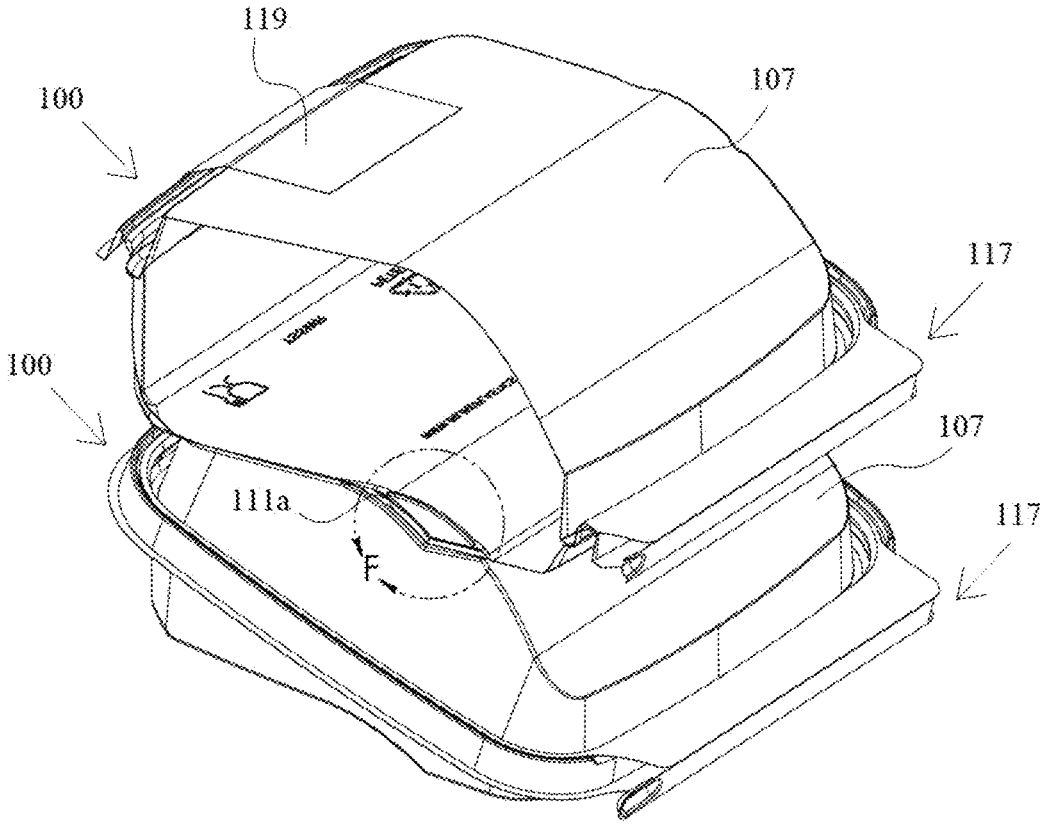
FIG. 1J illustrates two containers of the embodiment of FIG. 1A arranged in a stacked configuration, showing a first container stacked on a corresponding second container.
Figure 1K:
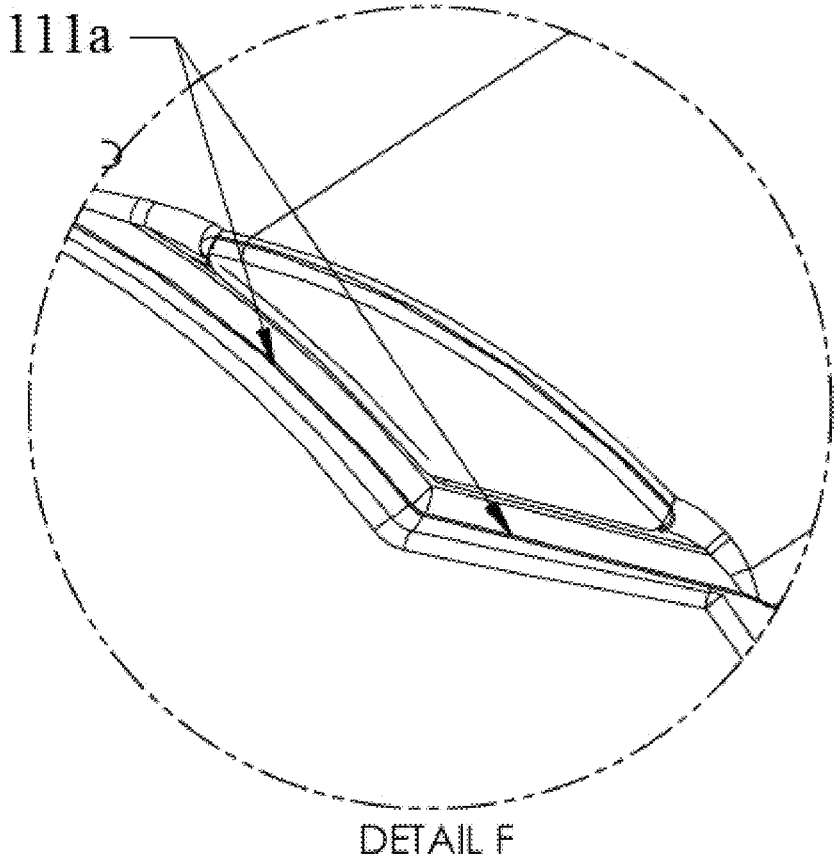
FIG. 1K illustrates an enlarged view of the embodiment of FIG. 1J, showing a stacking foot of the first container interlocking with a groove of the second container.
Figure 1L:
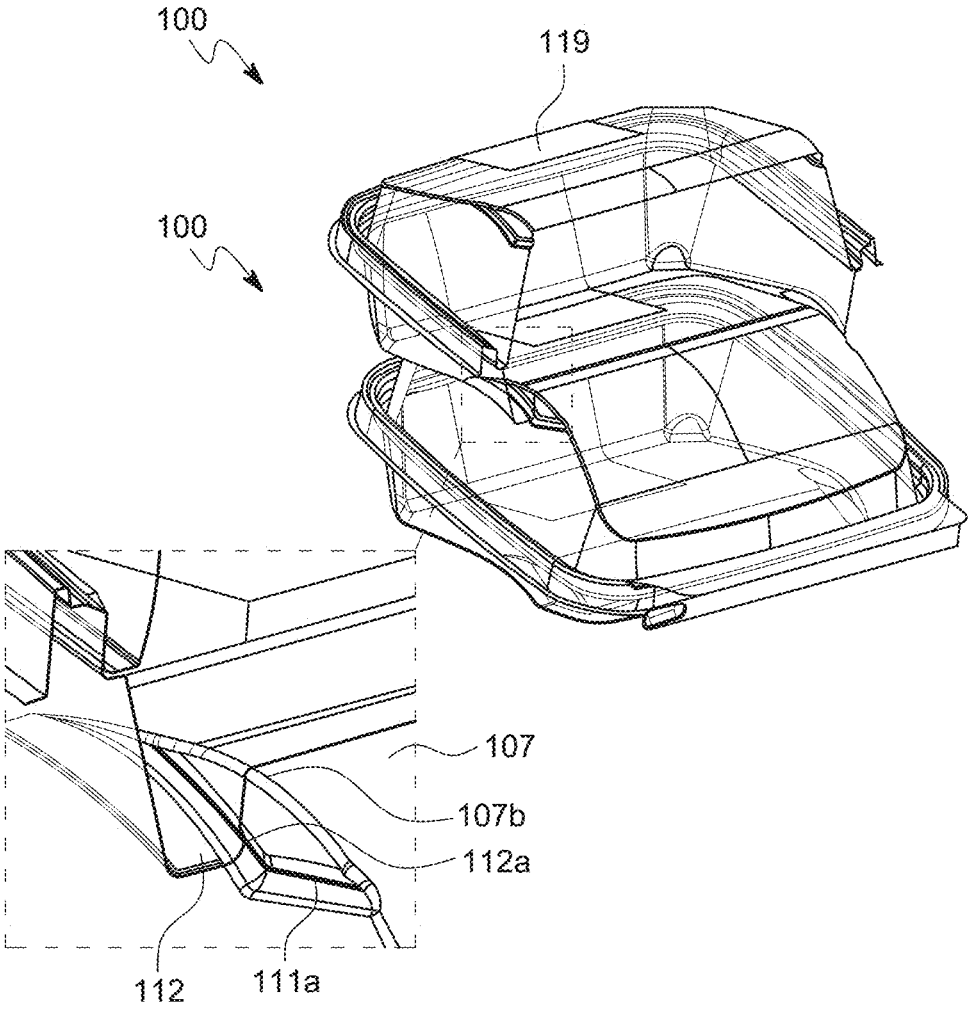
FIG. 1L illustrates a partial cross-section view of the embodiment of FIG. 1J, showing the first/top container sectioned and showing an enlarged view of the interlocking between the top container and the bottom container.
Figure 1M:
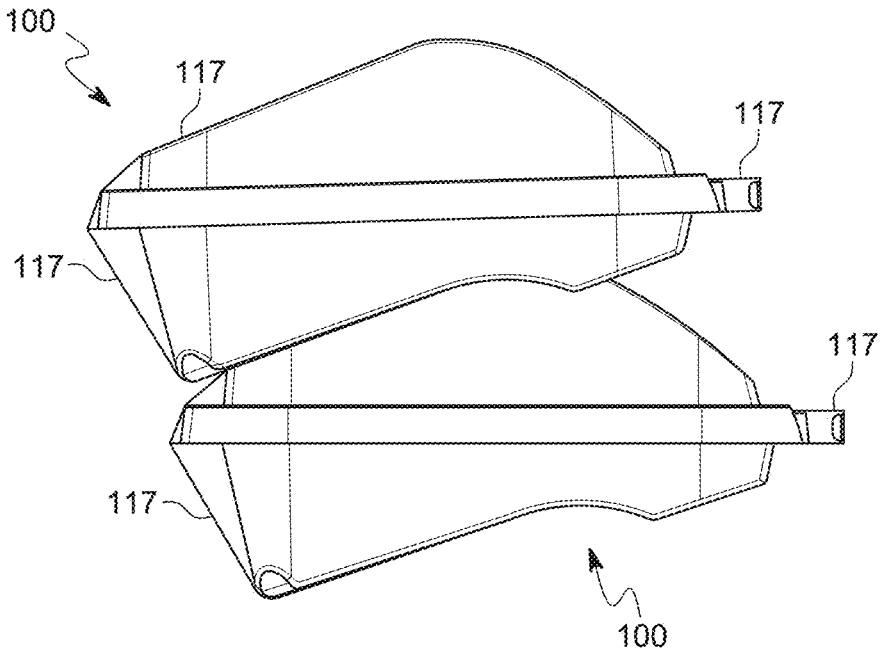
FIG. 1M illustrates a side elevation view of the embodiment of FIG. 1J, showing a label applied to each container.
Figure 1N:
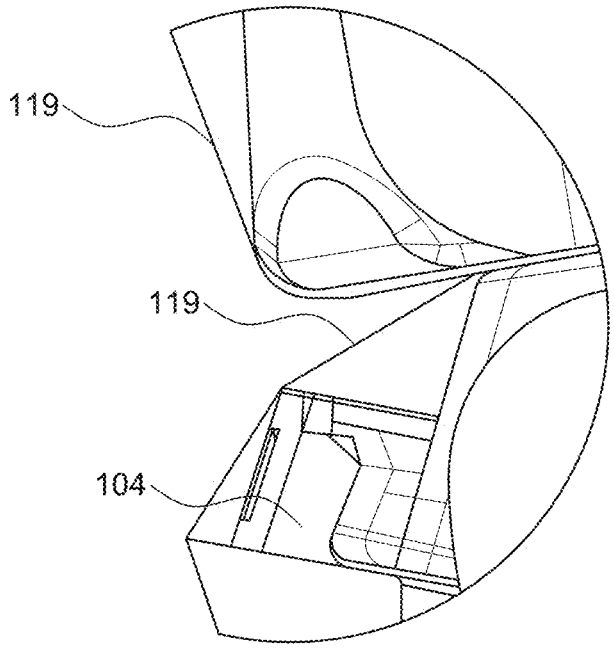
FIG. 1N illustrates an enlarged view of the embodiment of FIG. 1M, showing how the labels thereof do not interfere with each other when the containers are stacked.
Figure 1O:
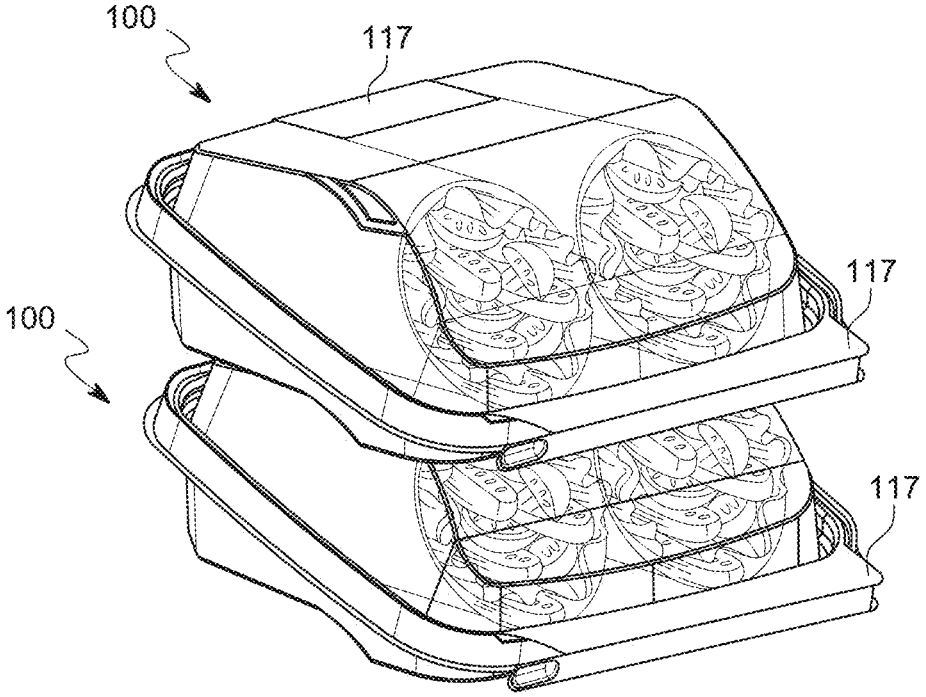
FIG. 1O illustrates a perspective view of the embodiment of FIG. 1J, showing the containers having a sandwich wrap disposed therein which illustrates the presentation of an item within the containers.

As shown in FIG. 1B, the base body 106 can include a mating surface 108 shaped to mate (e.g., flushly or otherwise) with a first portion (e.g., portion 107*c*) of the non-flat presentation surface 107 such that when a second corresponding container 100 is stacked upon the container 100, an inside of the container can be viewed through a second portion (e.g., portion 107*a*) of the non-flat presentation surface as shown in FIGS. 1J-1O). In certain embodiments, the shape of the mating surface is the same shape as a corresponding portion of the presentation surface 107. The shape of the mating surface 108 can be configured to allow an inside of a corresponding bottom container 100 to be viewed through the non-flat presentation surface 107 of the bottom container (e.g., as shown in FIG. 1O). In this regard, when stacked, a consumer can see an item within the container without having to remove the top container, for example.

The base body 106 can include one or more base body sides 110*a, b, c, d* connecting the mating surface 108 to the base sealing interface 104 (e.g., integrally). While embodiments shown include one or more base body sides 110*a, b, c, d*, delineated by an edge, it is contemplated that one or more (e.g., all) of the sides 110*a, b, c, d* may be smoothly connected to and/or part of the mating surface 108 such that the mating surface 108 is a continuous surface to the base sealing interface 104. For example, the base body front side 110*c* and/or rear side 110*d* can be a smooth extension of the mating surface 108 instead of having an edge as shown. In certain embodiments, the base body lateral sides 110*a*, 110*b* can be a smooth, laterally angled extension of the mating surface 108. Also, as shown, the one or more base body sides 110*a, b, c, d* can be smoothly connected in any suitable manner (e.g., via rounded corners).

Referring additionally to FIGS. 1C-1E, the base portion 102 can also include one or more stacking feet 112 extending from the base body 106 and arranged and configured to insert into the one or more stacking recesses 111 of the second corresponding container 100 when the container 100 is stacked on the second corresponding container 100 (e.g., such that the one or more stacking feet 112 engage the cover portion 101 to provide support in at least one direction to prevent relative movement between the top container and the bottom container). As shown, the stacking feet 112 can be a flush extension of the one or more base body sides 110*a, b*. In certain embodiments, such as that shown in FIGS. 1A-1Q, the stacking feet can extend from the base body 106 where the mating face includes a curved section (e.g., which is shaped to mate with a curved section of the non-flat presentation surface 107), for example. Any other suitable location is contemplated herein.

As shown in the embodiment of FIGS. 1A-1Q, the one or more recesses 111 can include one or more grooves 111*a* (e.g., two defined on opposite cover body sides 109*a*, 109*b*). The one or more stacking feet 112 can include two or more stacking feet 112, e.g., at least one for each groove 111*a*. The stacking feet 112 can include one or more ridges 112*a* configured to fit at least partially within the grooves 111*a* to engage the stacking feet to the cover portion 101. For example, the two or more stacking feet 112 can each include an ridge 112*a* that corresponds to the shape of the respective grooves 111*a* and can snap fit and/or lock with each groove 111*a* (e.g., as shown in FIGS. 1J, 1K, and 1L).

As shown, the grooves 111*a* and the ridges 112*a* can include a peaked shape. In certain embodiments, the grooves 111*a* and/or the ridges 112*a* can include a shape to allow the stacking feet 112 to be inserted (e.g., such as slid into the grooves 111*a*) or snapped in (e.g., by pushing the feet 112 down on the cover portion 101). For example, the material that forms container 100 can be a flexible plastic allowing elastic flexibility of the stacking feet 112.

In certain embodiments, the non-flat presentation surface 107 can include a curved portion 107*a* defining a peak 107*b*. In certain embodiments, the non-flat presentation surface 107 can also include a flat portion 107*c* extending from the curved portion 107*a*. The grooves 111*a* can be defined at the peak 107*b*, for example, as shown.

Referring to FIG. 1F-1I, in certain embodiments, the base body 106 can define a deep portion 106*a* and a shallow portion 106*b* such that a sitting contact plane 114 (i.e., defined by contact points of the base portion 102 when sitting on a flat surface) and a lip plane 116 (e.g., defined by the base sealing interface 104 such as the plane of the opening of the base portion 102) are non-parallel such that the base sealing interface 104 is angled forward when the base body 106 is resting on a flat surface. Referring to FIGS. 1M-1O, this, in turn, angles the cover body 105 forward when the cover sealing interface 103 and the base sealing interface 104 are mated to present the presentation surface 107 and to allow viewing of the inside of the bottom container 100 when stacked.

The angle between the sitting contact plane 114 and the lip plane 116 can be the same as a display shelf, e.g., about 10 degrees, or any other suitable angle. In certain embodiments, as shown in FIG. 1M, the container 100 can be configured such that stacking a container 100 offsets its relative position backward (using the lip plane 114 line as depicted in FIG. 1H as an axis) such that the top container 100 does not completely overhang the bottom container 100. This can also position the center of gravity of a stack in a more favorable position for an angled shelf. The relative position of the top container 100 can be changed by changing the location of the stacking feet 112 and/or the shape/position of the mating surface 108.

The container 100 can include a living hinge 117 connecting the cover portion 101 to the base portion 102. In certain embodiments, the living hinge 117 can include at least one score line or line of weakness. For example, the living hinge can include a tamper resistant tear tab 117*a* that is configured to be torn off (e.g., at the score line or weakness) to destroy the living hinge 117 and separate the cover portion 101 and the base portion 102. As shown, the cover portion 101 and the base portion 102 can include hinge extensions 117*b*, 117*c*, respectively, that attach to the tear tab 117*a* (e.g., via a perforated or weakened connection, or in any other suitable manner as appreciated by those having ordinary skill in the art). In certain embodiments, the living hinge 117 may be not removable or destroyable.

Referring to FIGS. 1M-1O, when closed, a label 119 can be adhered to the container 100, e.g., on the opposite side as the living hinge 117 as shown, to seal the cover portion 101 to the base portion 102. This can maintain a seal of the cover portion 101 and the base portion 102 and provide visual assurance to a consumer that the contents have not been tampered with when the hinge 117 and the label 119 are intact. Also, in certain embodiments, e.g., as shown in FIGS. 1A-1Q, the containers 100 are configured to prevent label interference such that the labels 119 do not touch each other when containers are stacked, e.g., as shown in FIG. 1N.

Figure 1P:
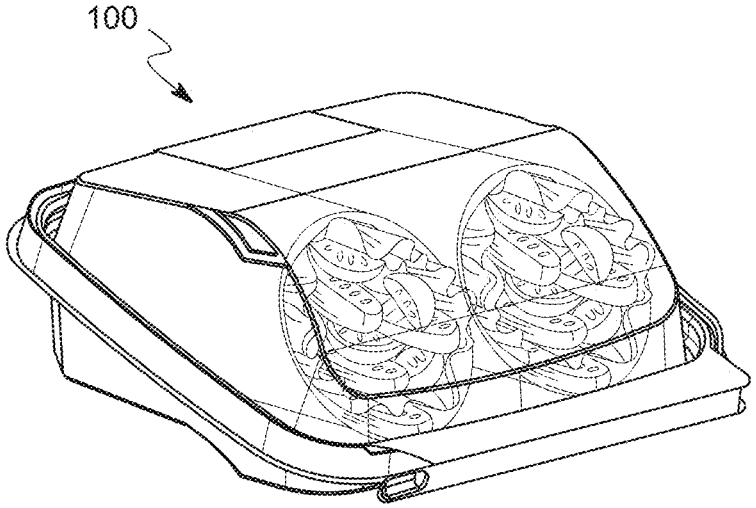
FIG. 1P illustrates a perspective view of the embodiment of FIG. 1A, shown having an item of food therein and in a sitting position.
Figure 1Q:
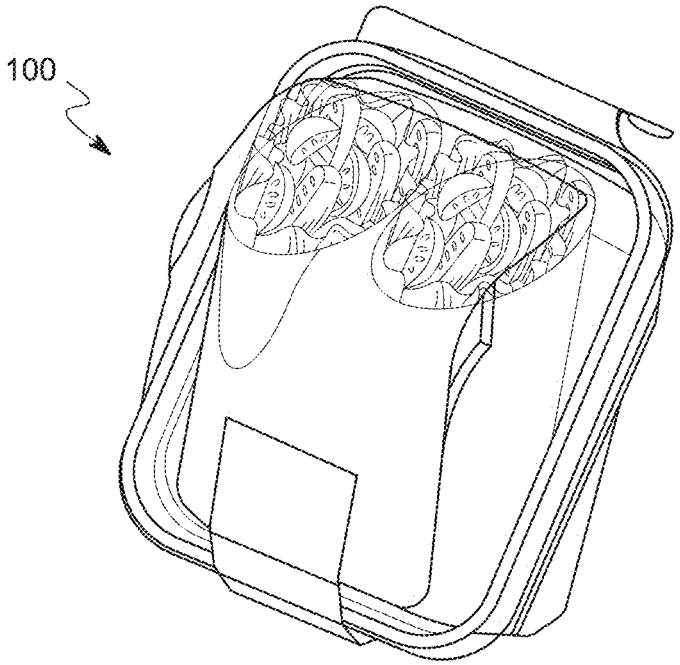
FIG. 1Q illustrates a perspective view of the embodiment of FIG. 1A, shown having an item of food therein and in a standing position.

Referring to FIGS. 1P and 1Q, the base portion 101 can be shaped to allow for two or more stable positions. For example, as shown in FIG. 1P, the container 100 can be stable in a sitting position which angles the base sealing interface 104 (and thus the cover portion 101) forward. As shown in FIG. 1O, the container 100 can be stable in at least one standing position, e.g., resting on the rear side 110*d* of the base body 106 and the base sealing interface 104.

The recesses and/or stacking feet as described herein can include any suitable shape and location. For example, referring now to FIGS. 2A-2Q, the embodiment of a container 200 shown can include similar features as the embodiment of FIGS. 1A-1Q as described above, however, the location and shape of the one or more recesses 211 and the one or more stacking feet 212 are different, for example.

Figure 2B:
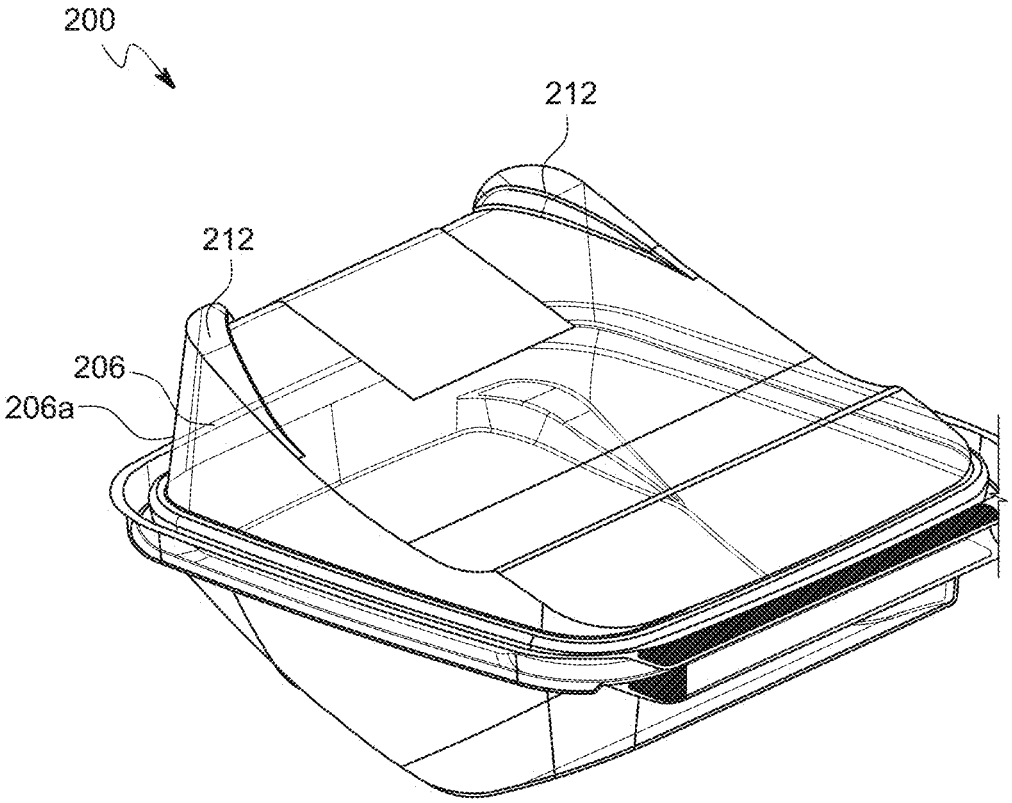
FIG. 2B illustrates a perspective view taken from below of the container embodiment of FIG. 2A, showing the base portion and in a closed state.
Figure 2C:
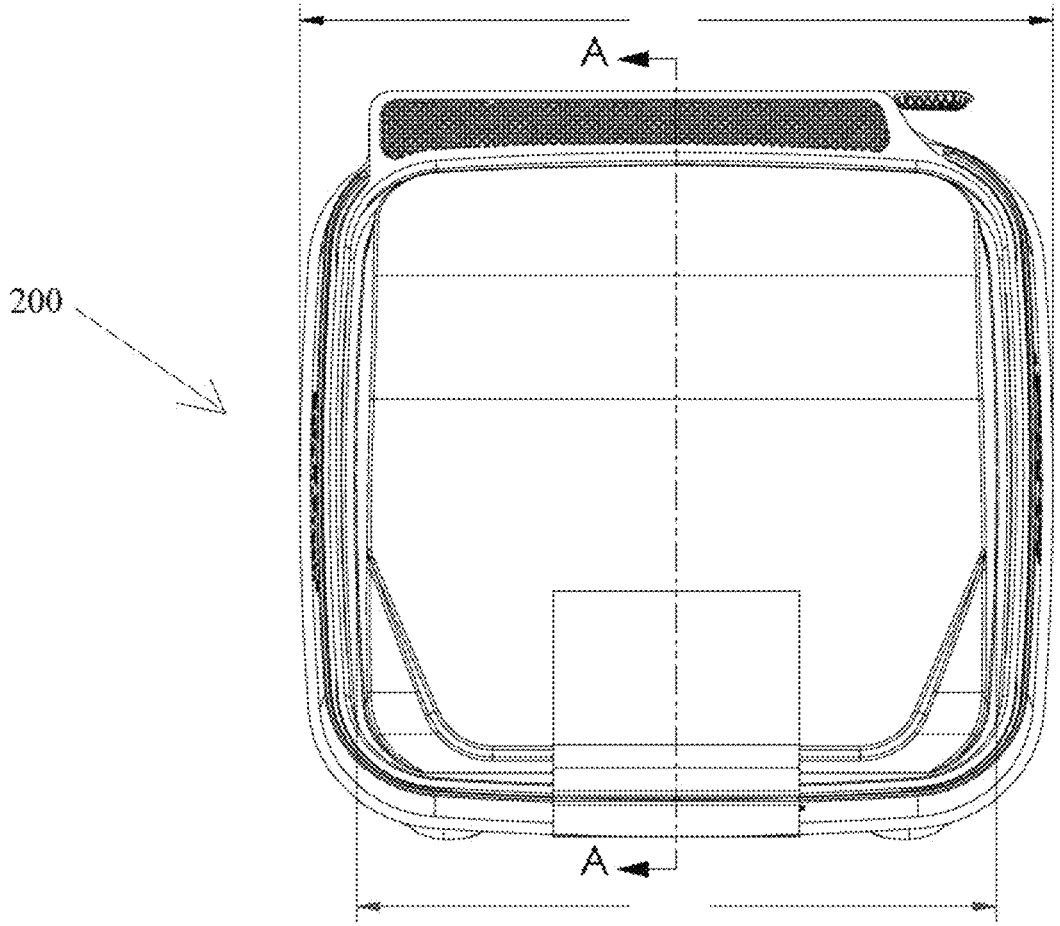
FIG. 2C illustrates a top down view of the container embodiment of FIG. 2A.
Figure 2D:
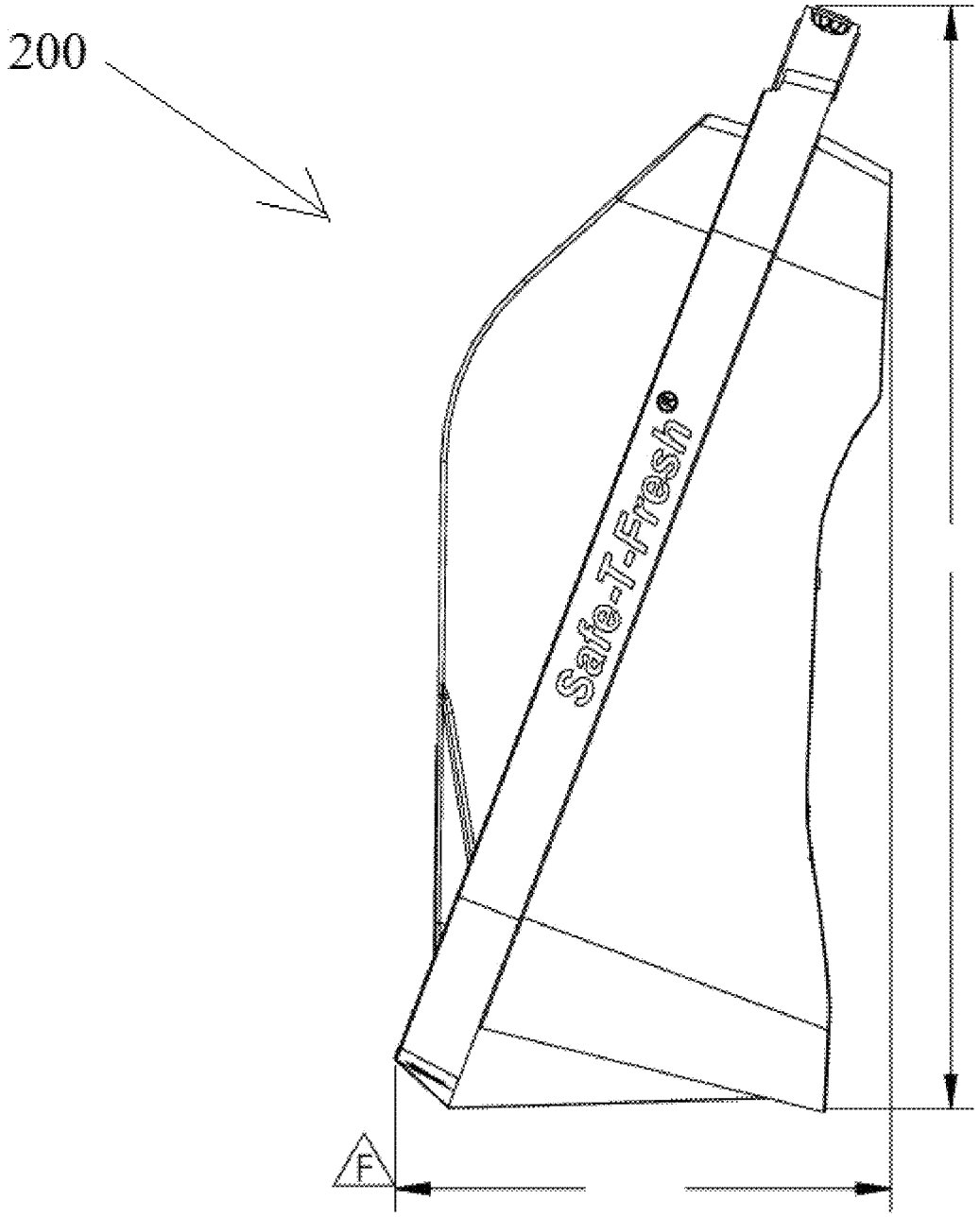
FIG. 2D illustrates a side elevation view of the container embodiment of FIG. 2A.
Figure 2E:
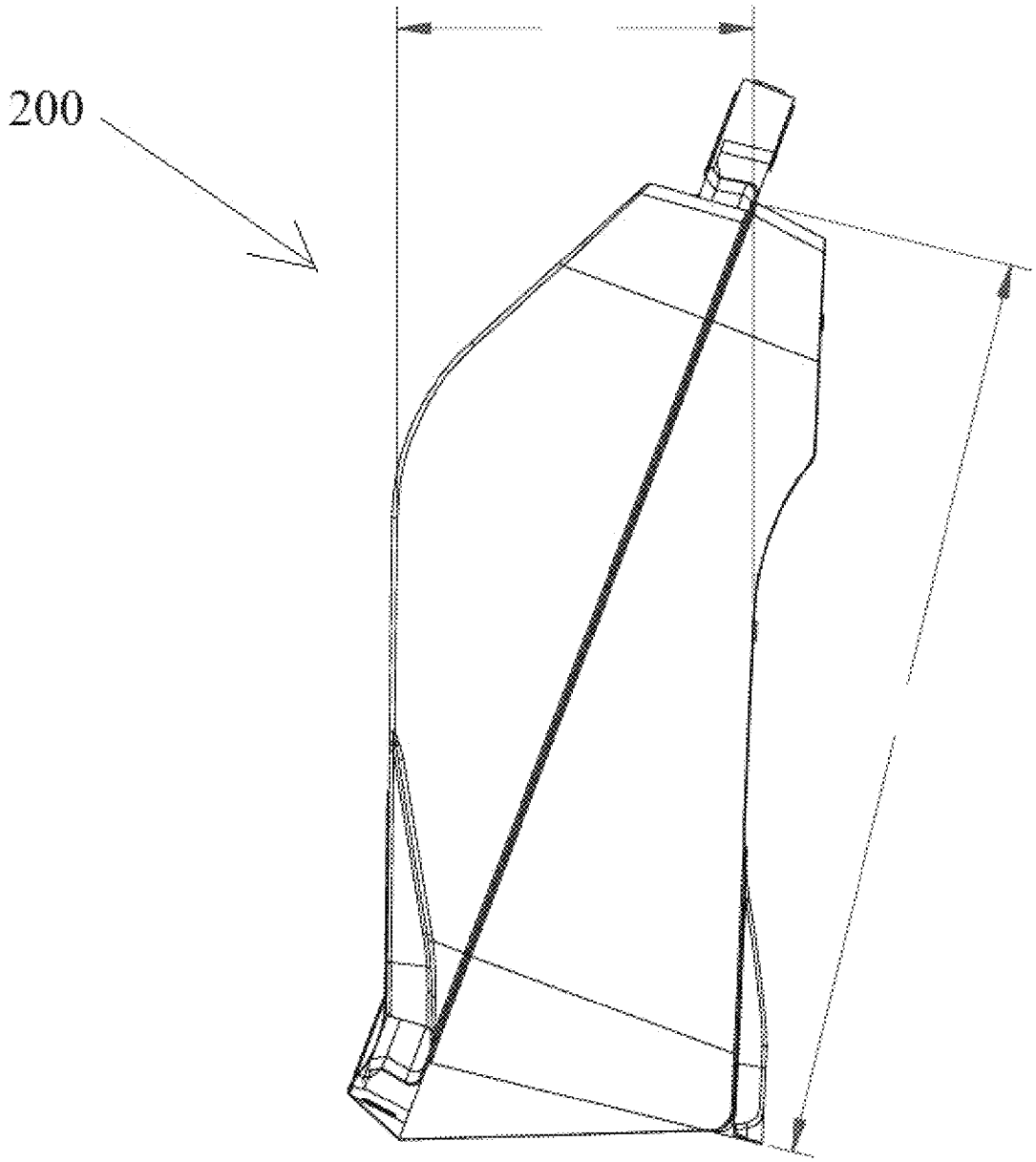
FIG. 2E illustrates a cross-sectional view of the container embodiment of FIG. 2C taken along cut line A-A.
Figure 2F:
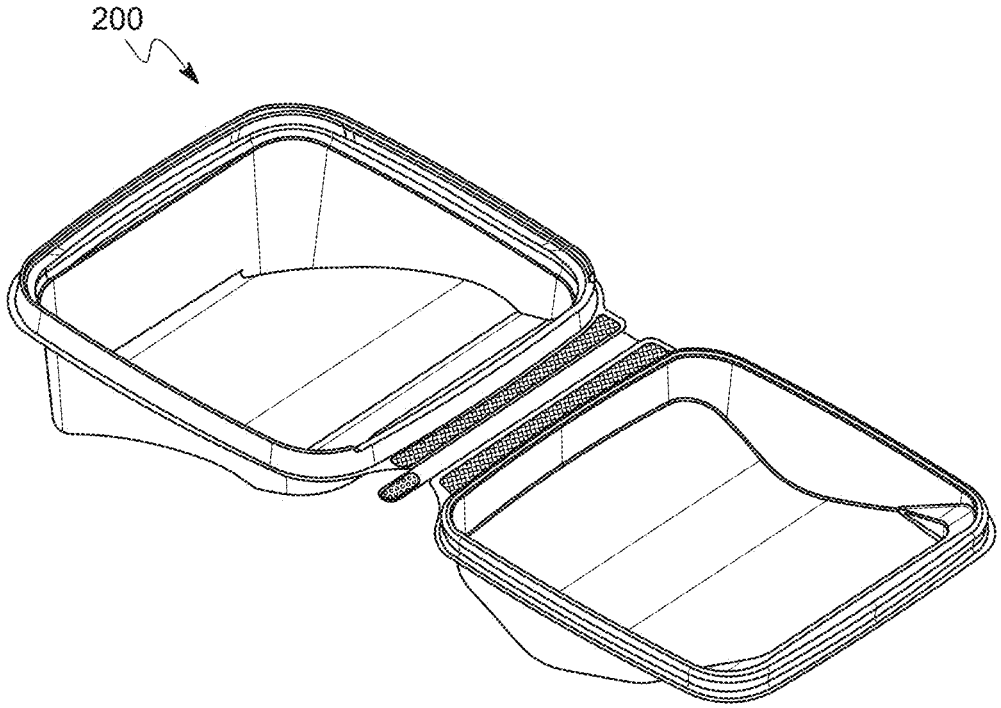
FIG. 2F illustrates a perspective view of the container embodiment of FIG. 2A, shown in an open state.
Figure 2G:
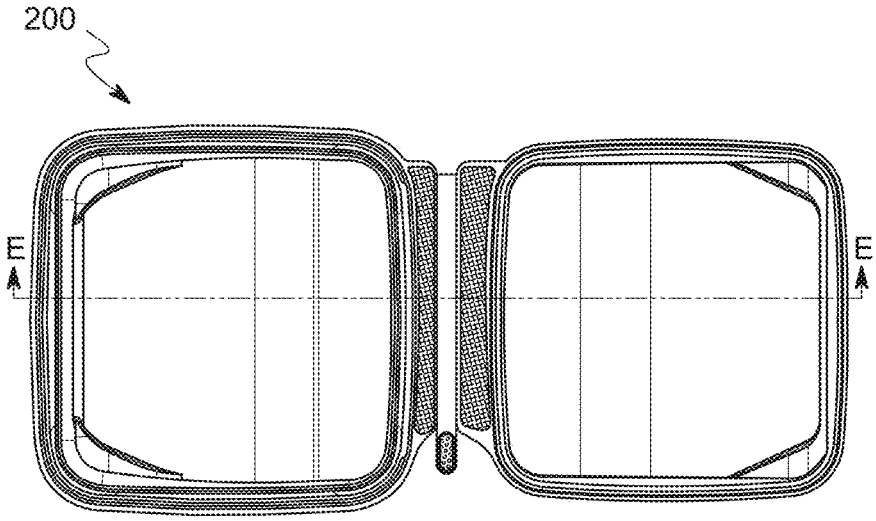
FIG. 2G illustrates a top down view of the container embodiment of FIG. 2F.
Figure 2H:
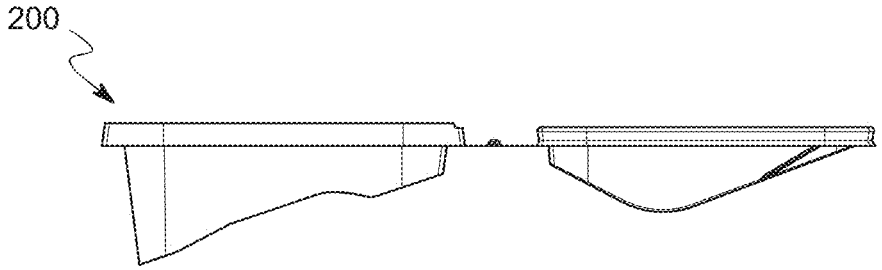
FIG. 2H illustrates a side elevation view of the container embodiment of FIG. 2F.
Figure 2I:
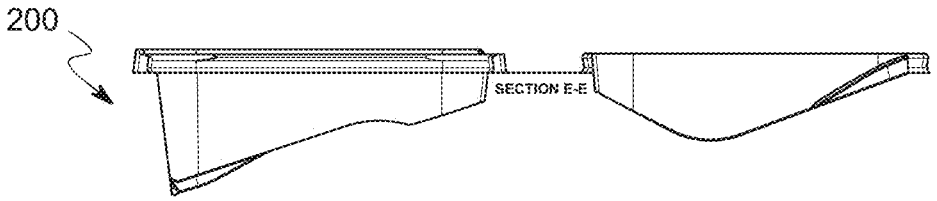
FIG. 2I illustrates a cross-sectional view of the container embodiment of FIG. 2G taken along cut line E-E.
Figure 2J:
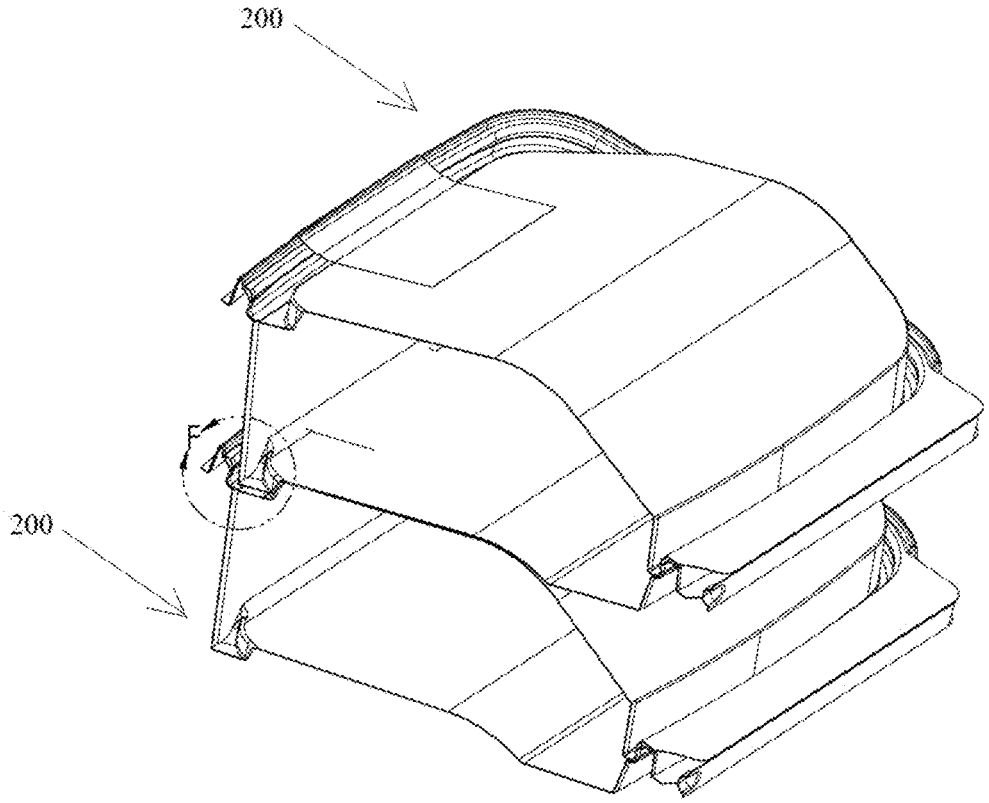
FIG. 2J illustrates perspective, partial cross-sectional view of two containers of the container embodiment of FIG. 2A arranged in a stacked configuration, showing a first container stacked on a corresponding second container.
Figure 2K:
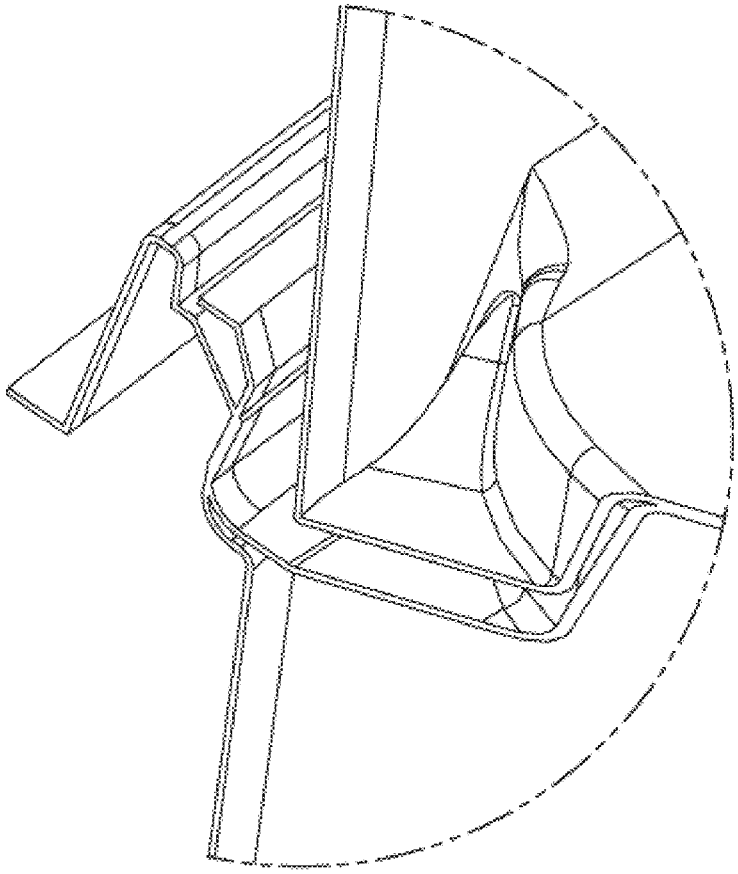
FIG. 2K illustrates an enlarged view of the container embodiment of FIG. 2J, showing a stacking foot of the first container interlocking with an recess of the second container.
Figure 2L:
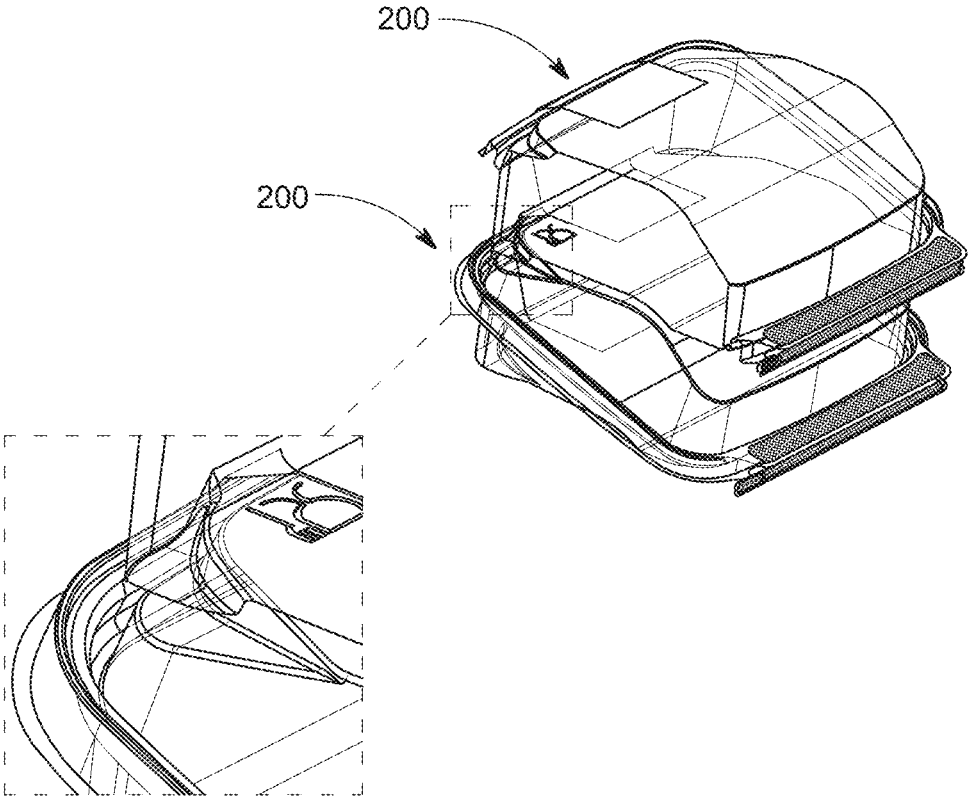
FIG. 2L illustrates a partial cross-section view of the container embodiment of FIG. 2J, showing the first/top container sectioned and showing an enlarged view of the interlocking between the first/top container and the second/bottom container.
Figure 2M:
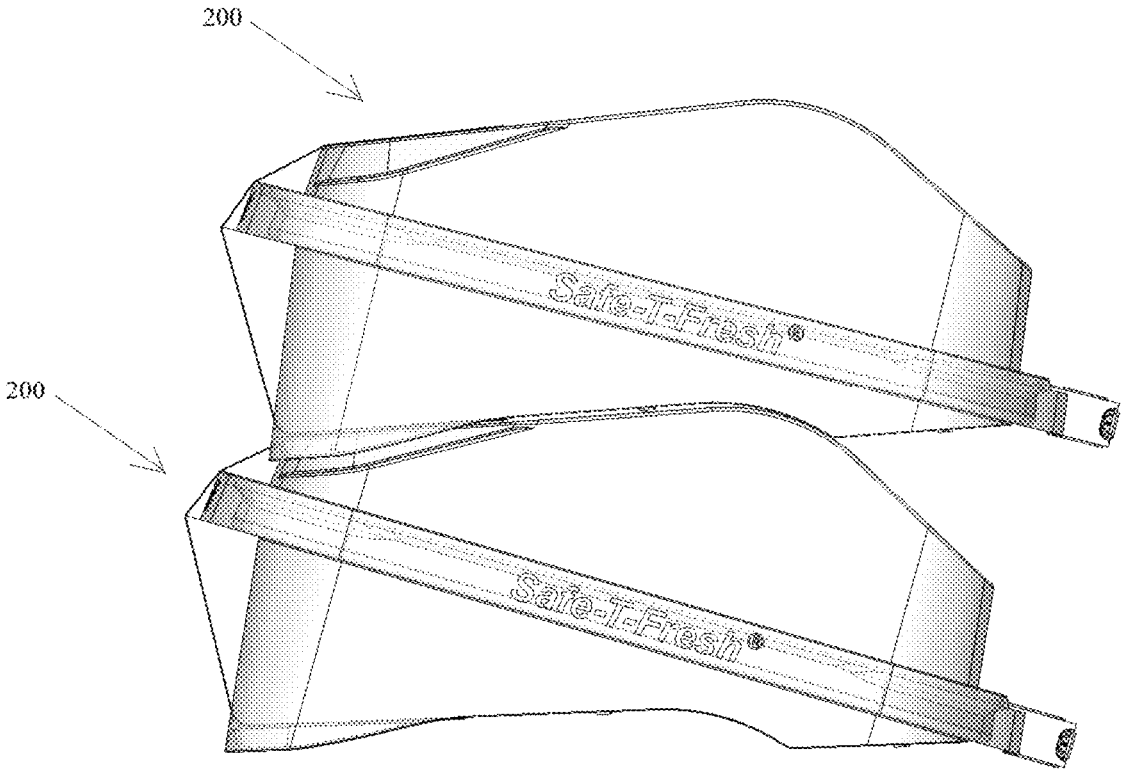
FIG. 2M illustrates a side elevation view of the container embodiment of FIG. 2J, showing a label applied to each container.
Figure 2N:
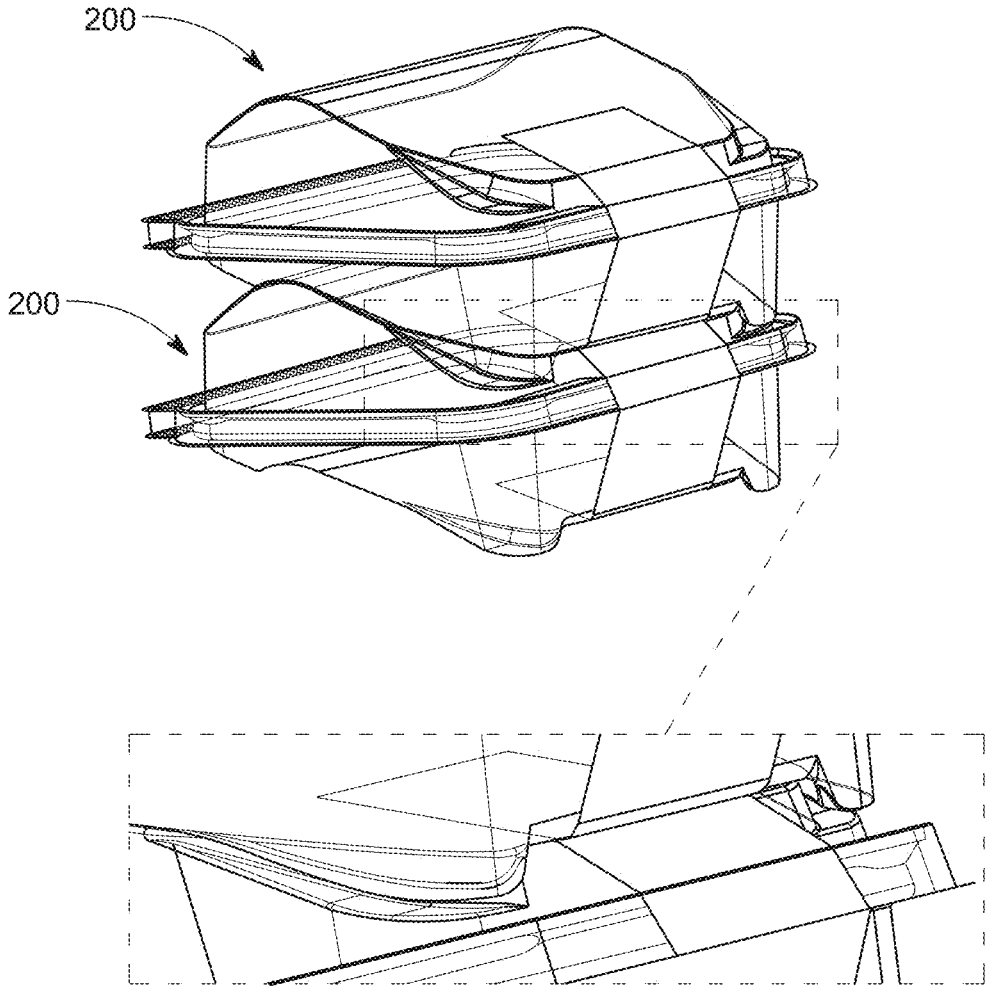
FIG. 2N illustrates a perspective and zoomed view of the container embodiment of FIG. 2M, showing how the labels thereof do not interfere with each other when the containers are stacked.
Figure 20:
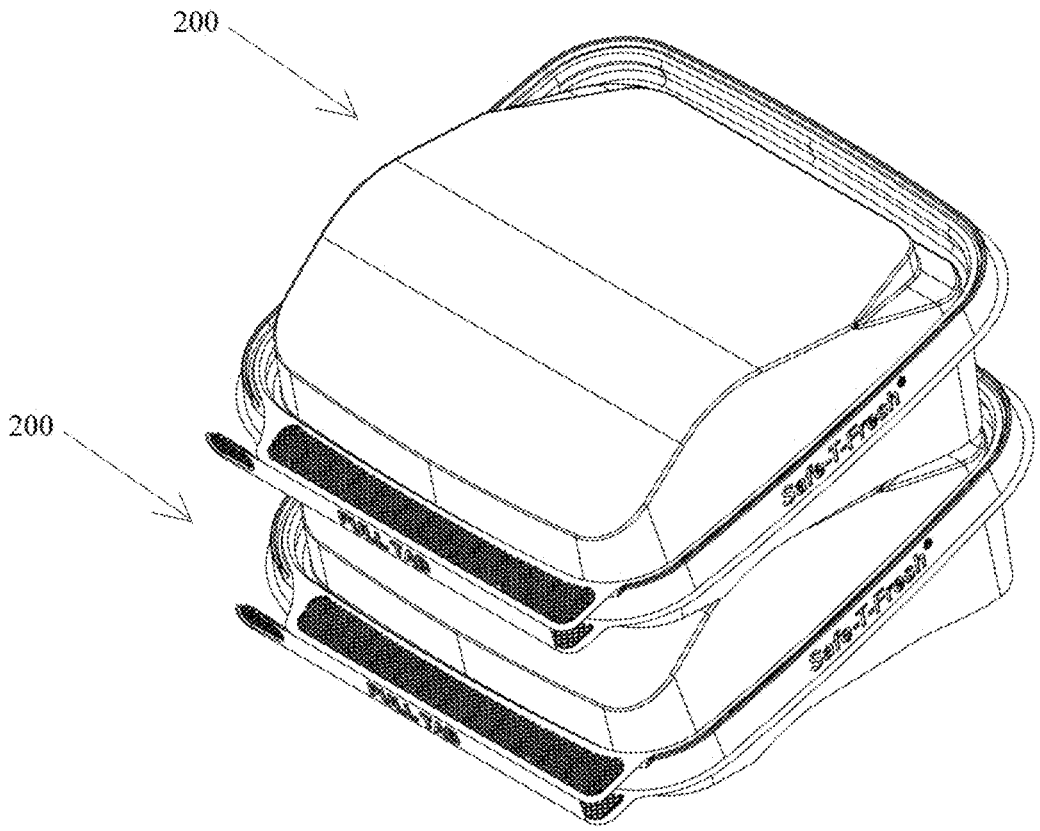
Figure 2P:
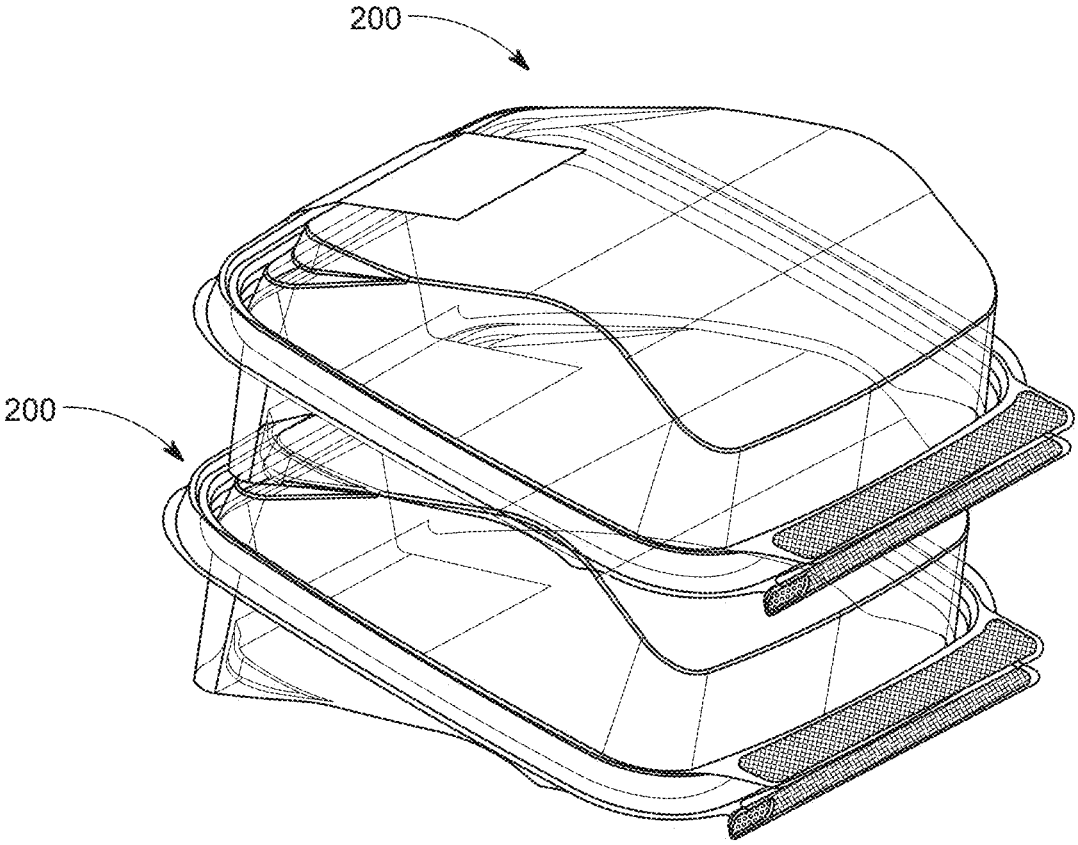
FIG. 2P illustrates a perspective view of the container embodiment of FIG. 2A, shown in a sitting position and stacked.

As shown in FIGS. 2A and 2B, in certain embodiments, the one or more recesses 211 can include two or more recesses 211. Each recess 211 can be defined on a corner 205*a* of the cover body 205 such that the two or more recesses wrap around a respective corner 205*a*. In such embodiments, each of the stacking feet 212 can be defined at a corner 206*a* of the base body 206 and can include a similar wrap around shape. Such an embodiment can provide stability in three directions, e.g., each sideways direction and the forward direction.

Referring now to FIGS. 3A-3Q, the embodiment of a container 300 shown can include similar features as the embodiment of FIGS. 1A-1Q as described above, however, the location and shape of the one or more recesses 311 and the one or more stacking feet 312 differ. For example, in certain embodiments, the one or more recesses 311 can include a single recess 311 defined in a rear portion of the cover body 305, and the one or more stacking feet 312 include a single stacking foot 312. The stacking recess 311 can include a channel shaped recess defined by a rear portion of the base body 306. The stacking foot 312 can include a bar shape, for example, and can be dimensioned to fit in the stacking recess 312 snugly or loosely in any suitable manner. Such a stacking foot can provide at least three directions of stability, e.g., as described above with respect to the embodiment of FIGS. 2A-2Q.

Figure 4A:
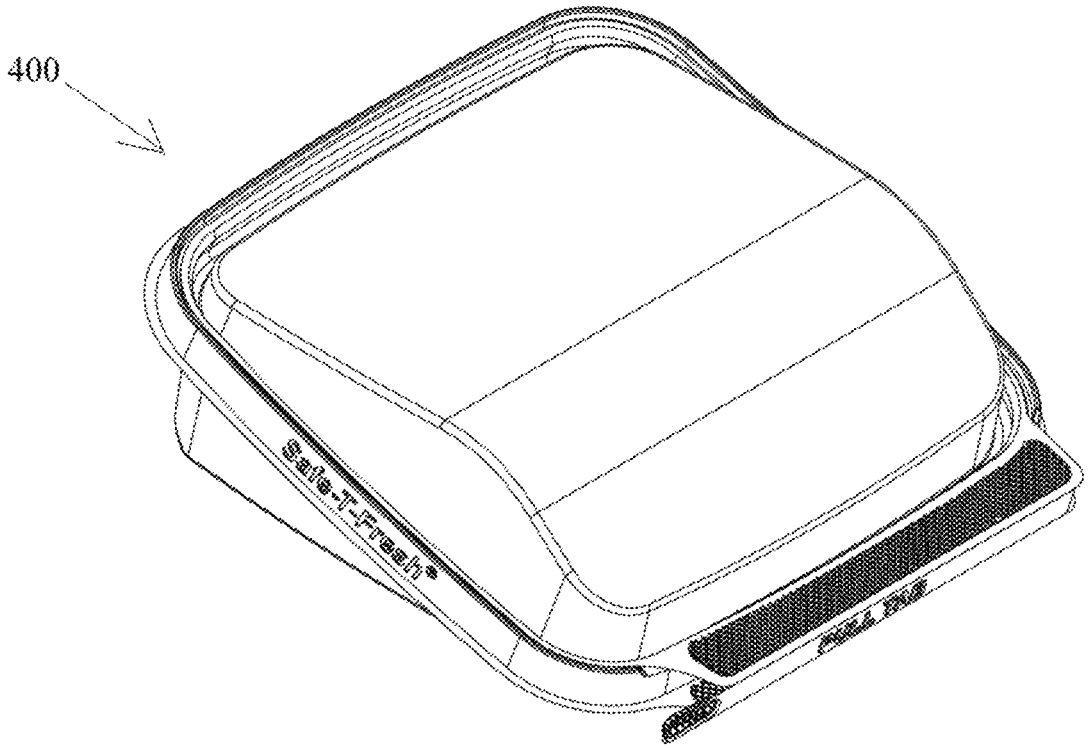
FIG. 4A illustrates a perspective view of an embodiment of a container in accordance with this disclosure.
Figure 4B:
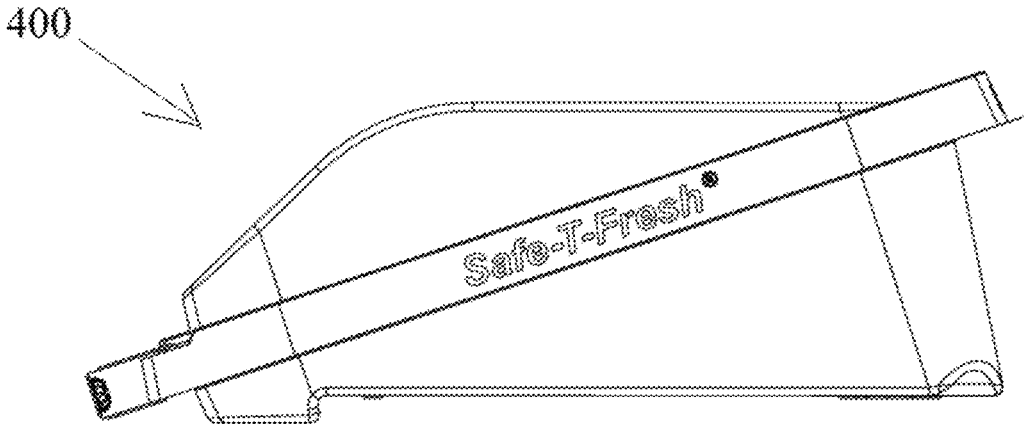
FIG. 4B illustrates a side elevation view of the container embodiment of FIG. 4A.
Figure 4C:
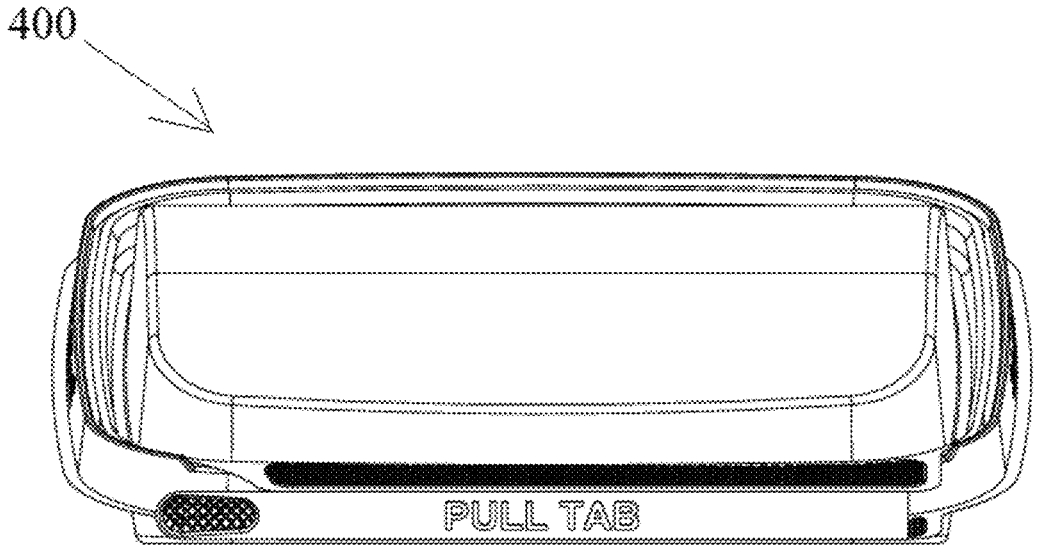
FIG. 4C illustrates a front elevation view of the container embodiment of FIG. 4A.
Figure 4D:
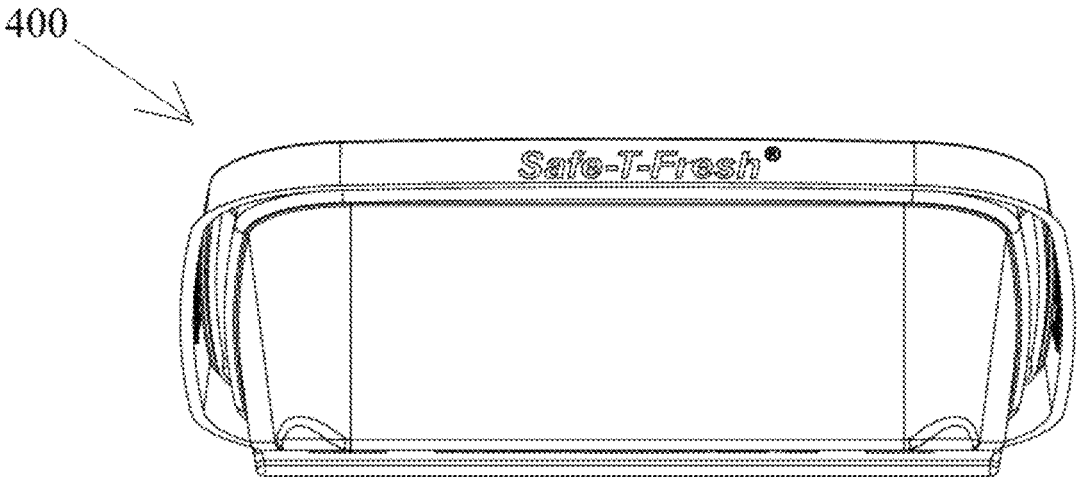
FIG. 4D illustrates a rear elevation view of the container embodiment of FIG. 4A.
Figure 4E:
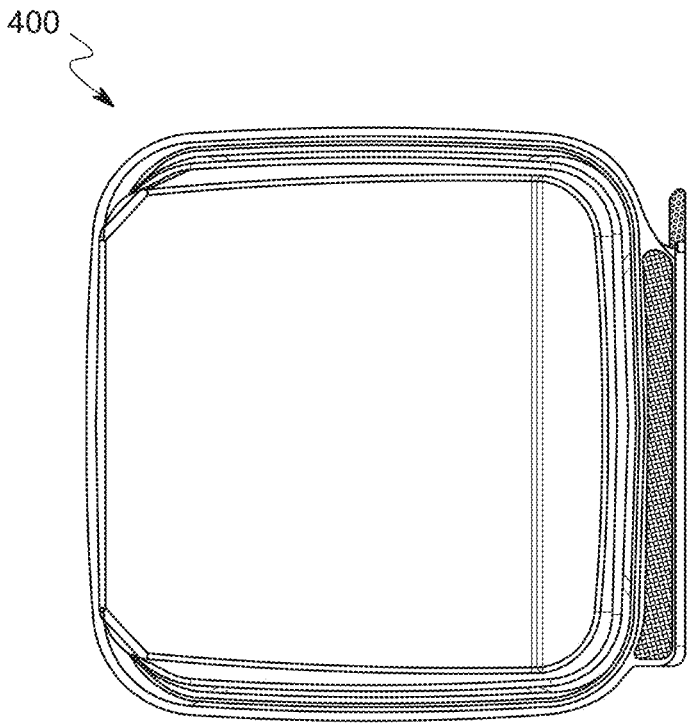
FIG. 4E illustrates a bottom plan view of the container embodiment of FIG. 4A.
Figure 4F:
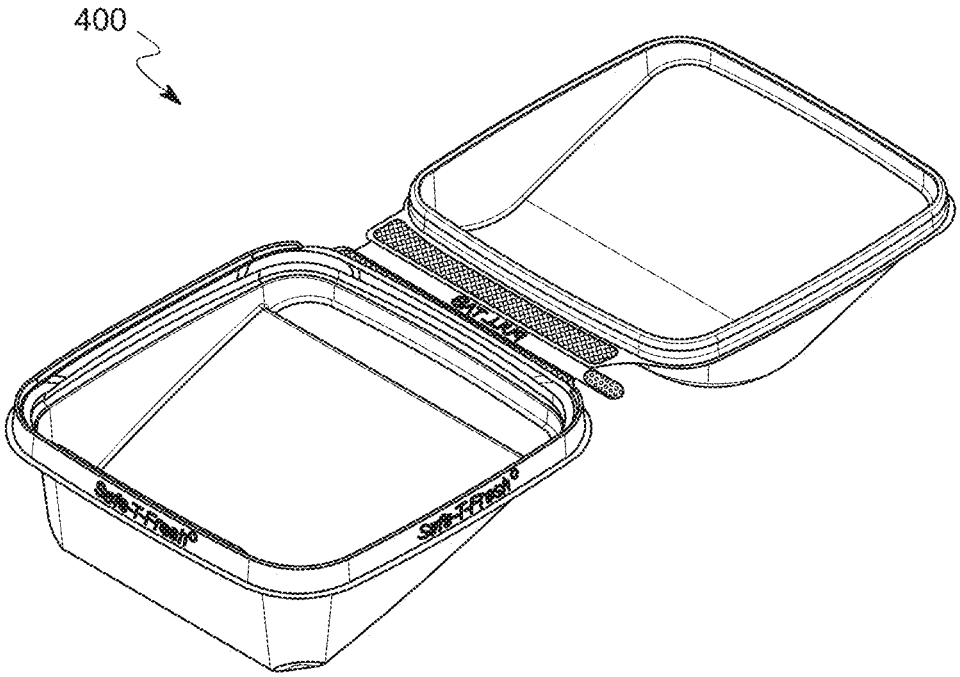
FIG. 4F illustrates a perspective view of the container embodiment of FIG. 4A, shown open.
Figure 4G:
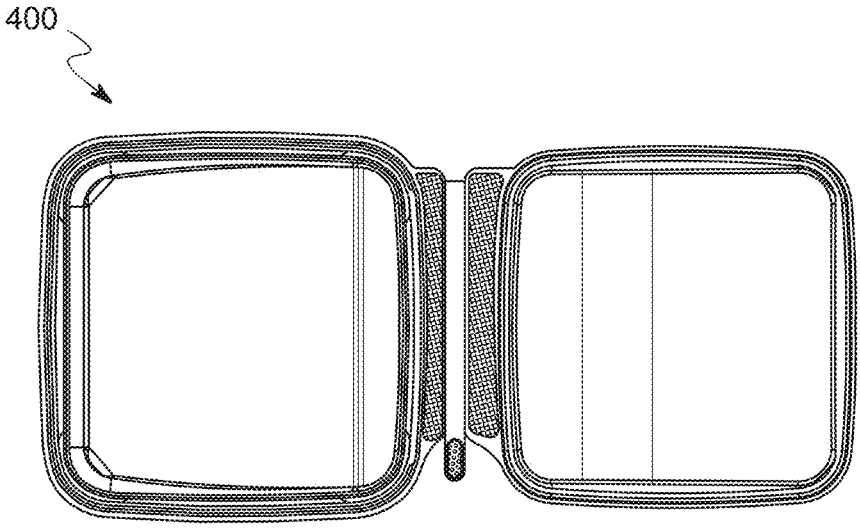
FIG. 4G illustrates a top down plan view of the container embodiment of FIG. 4F.
Figure 4H:
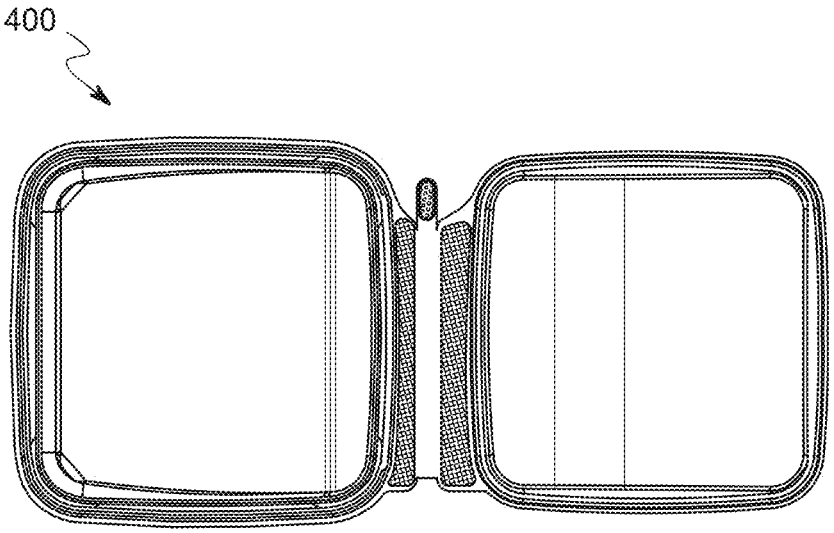
FIG. 4H illustrates a bottom up plan view of the container embodiment of FIG. 4F.
Figure 4I:
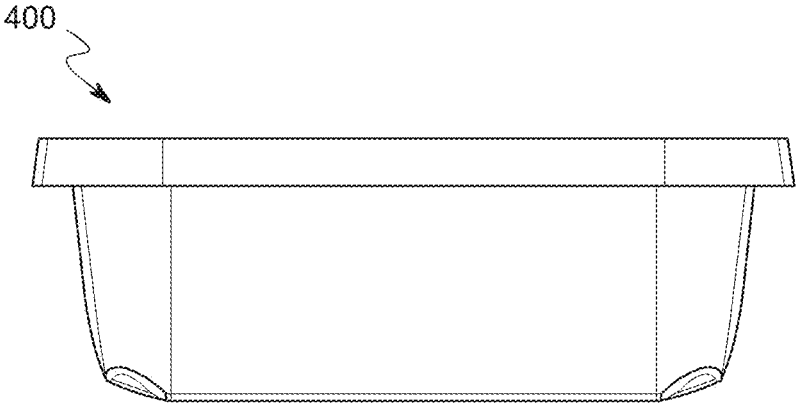
FIG. 4I illustrates a rear elevation view of the container embodiment of FIG. 4F.
Figure 4J:
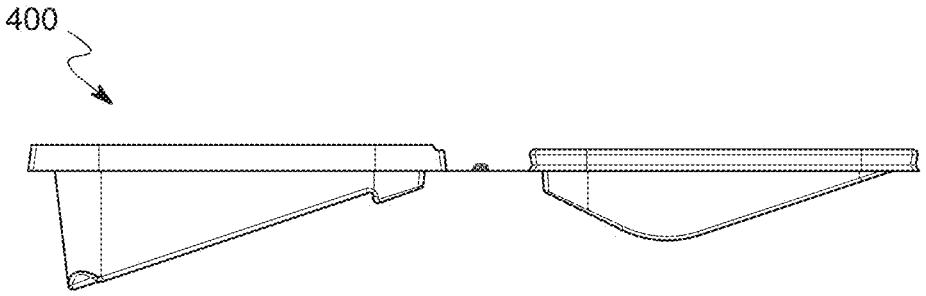
FIG. 4J illustrates a left side elevation view of the container embodiment of FIG. 4F.
Figure 4K:
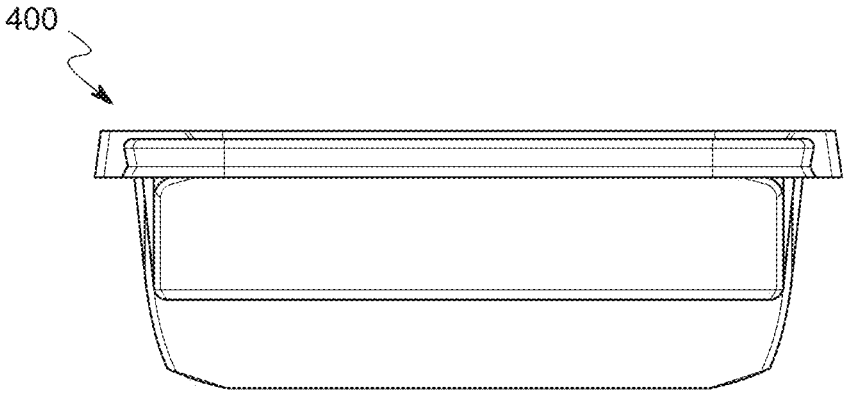
FIG. 4K illustrates a front elevation view of the container embodiment of FIG. 4F.
Figure 4L:
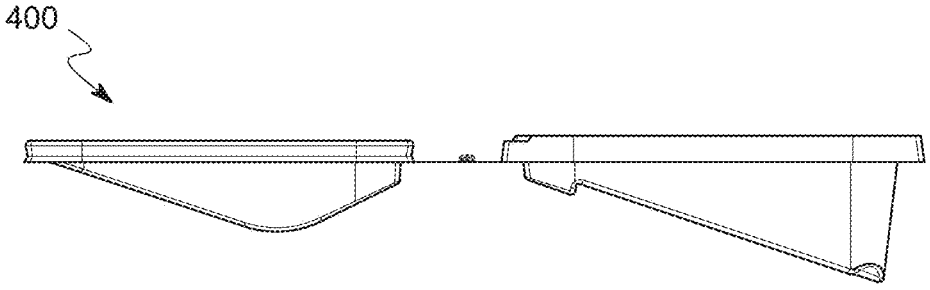
FIG. 4L illustrates a right side elevation view of the container embodiment of FIG. 4F.
Figure 4M:
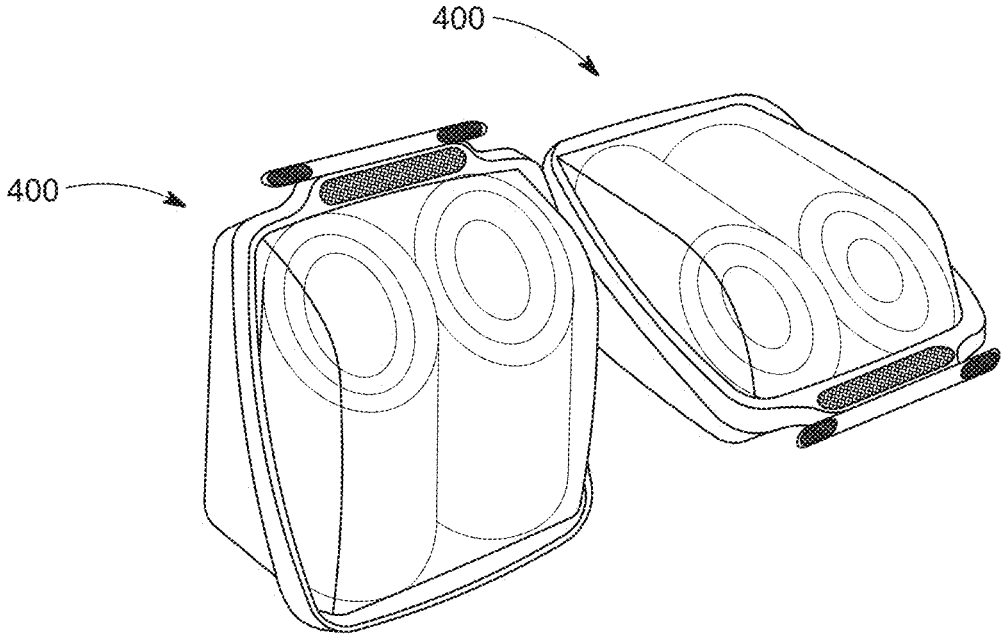
FIG. 4M illustrates a perspective view two of the container embodiment of FIG. 4A, shown having an item of food therein and in a sitting position on the right and in the standing position on the left.

FIGS. 4A-4M illustrate another embodiment of a container 400 that can include similar features as the above described embodiments, without specific stacking features or recesses. However, certain embodiments, e.g., as shown, can still be stacked without such features to prevent relative movement (on an angled or flat shelf). Also, such an embodiment can be placed in at least two stable positions, e.g., as shown in FIG. 4M and described above.

As shown, each embodiment can be configured to be stable in two positions (e.g., such that it can stand on a side or sit mating surface down). However, it is contemplated that the containers 100, 200, 300 can be configured to only be stable in the sitting position.

Embodiments include tamper evident plastic sandwich wrap containers that enhances food presentation for, e.g., wedges, hoagies, wraps, and/or sandwiches with multiple ways of presenting in the market place while increasing shelf space efficiency by allowing multiple containers to be stacked. Embodiments allow stackability even when using a "wrap-around" label due to embodiments preventing label interaction.

Certain embodiments allow a panoramic viewing window curve, e.g., to the lip, which allows food to present itself. Certain embodiments reflect that profile curve on the cover portion to the base portion, which provides complementary curves that function as alignment and balance when stacked. Embodiments stack using grooves that provide an interlocking relationship that utilizes undercuts and, e.g., a bead shaped rib. In certain embodiments, due to the stacking feature being closer to the side walls, e.g., and only coming in about 0.50" on the base portion, no interference with the label can occur to jeopardize the product or package.

Traditional tamper evident container design, e.g., for sandwiches, hoagies, and wraps are not properly stackable and/or stable, and do not display the item in the container with a panoramic window. Embodiments can be stacked, e.g., two high while presenting on a shelf that is angled, e.g., about 10 degrees, without sliding off the shelf or one another.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges may independently be included in the smaller ranges is also encompassed within this disclosure, subject to any specifically excluded limit in the stated range. Where the stated range includes one or both of the limits, ranges excluding either both of those included limits are also included in this disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the disclosed embodiments, exemplary methods and materials are now described. All publications mentioned herein are incorporated herein by reference to disclose and describe the methods and/or materials in connection with which the publications are cited.

It must be noted that as used herein and in the appended claims, the singular forms "a", "an," and "the" include plural referents unless the context clearly dictates otherwise. Thus, for example, reference to "a stimulus" includes a plurality of such stimuli and reference to "the signal" includes reference to one or more signals and equivalents thereof known to those skilled in the art, and so forth.

Any suitable combination(s) of any disclosed embodiments and/or any suitable portion(s) thereof are contemplated herein as appreciated by those having ordinary skill in the art.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The descriptions above and the accompanying drawings should be interpreted in the illustrative and not the limited sense. While this disclosure has been disclosed in connection with the embodiments disclosed herein, it should be understood that there may be other embodiments which fall within the scope of this disclosure and the following claims.

Where a claim, if any, is expressed as a means or step for performing a specified function, it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A stackable display container, comprising:

(a) a cover portion including a cover sealing interface and a cover body extending from the cover sealing interface, the cover body having:

(i) a non-flat presentation surface, including a first curved portion and a second flat portion, wherein the curved portion of the non flat presentation defines a peak and the flat portion of the non-flat presentation extends from the curved portion;

(ii) two or more cover body sides connecting the non-flat presentation surface to the cover sealing interface; and (iii) two or more stacking recesses defined in the cover body, the two or more recesses including two or more grooves defined at the peak on opposite cover body sides; and (b) a base portion including a base sealing interface configured to mate with the cover sealing interface, and a base body extending from the base sealing interface, the base body having:

(i) a mating surface shaped to mate with a first flat portion of the non-flat presentation surface of the cover portion such that when a second corresponding container is stacked upon the container, an inside of the container can be viewed through a second curved portion of the non-flat presentation surface;

(ii) one or more base body sides connecting the mating surface to the base sealing interface; and (iii) two or more stacking feet extending from the base body and arranged and configured to insert into the two or more stacking recesses of the second corresponding container when the container is stacked on the second corresponding container.

2. The container of claim 1, wherein a sitting contact plane is defined by contact points of the base portion when sitting on a flat surface, wherein a lip plane is defined by the base sealing interface, and wherein the base body defines a deep portion and a shallow portion such that the sitting contact plane and the lip plane are non-parallel such that the base sealing interface is angled forward when the base body is resting on a flat surface, which angles the cover body forward when the cover sealing interface and the base sealing interface are mated.

3. The container of claim 2, further comprising a living hinge connecting the cover portion to the base portion.

4. The container of claim 3, wherein the living hinge includes at least one score line or line of weakness.

5. The container of claim 1, wherein the mating surface is shaped to mate flushly with the first flat portion of the non-flat presentation surface.

6. The container of claim 1, wherein the two or more stacking feet each include an inwardly extending ridge that snap fits and/or locks with each groove.

7. A display container, comprising:

(a) a cover portion including a cover sealing interface and a cover body extending from the cover sealing interface, the cover body having:

(i) a non-flat presentation surface, including a first curved portion and a second flat portion;

(ii) two or more cover body sides connecting the non-flat presentation surface to the cover sealing interface;

(iii) two or more stacking recesses defined in the cover body that includes two or more grooves defined on opposite cover body sides;

(b) a base portion including a base sealing interface configured to mate with the cover sealing interface, and a base body extending from the base sealing interface, the base body having:

(i) a mating surface shaped to mate with a first flat portion of the non-flat presentation surface of the cover portion such that when a second corresponding container is stacked upon the container, an inside of the container can be viewed through a second curved portion of the non-flat presentation surface;

(ii) one or more base body sides connecting the mating surface to the base sealing interface;

(iii) two or more stacking feet extending from the base body and arranged and configured to insert into the two or more stacking recesses of the second corresponding container when the container is stacked on the second corresponding container; and wherein the base body defines a deep portion and a shallow portion such that a sitting contact plane, defined by contact points of the base portion when sitting on a flat surface, and a lip plane defined by the base sealing interface are non-parallel such that the base sealing interface is angled forward when the base body is resting on a flat surface, which angles the cover body forward when the cover sealing interface and the base sealing interface are mated to present the presentation surface and to allow viewing of the inside of the container when stacked; and wherein the curved portion of the non-flat presentation defines a peak and the flat portion of the non-flat presentation extends from the curved portion, and wherein the grooves are defined at the peak; and (c) a living hinge connecting the cover portion to the base portion, wherein the living hinge is defined adjacent the shallow portion of the base portion along at least a partial width of the cover sealing interface and base sealing interface.

8. The container of claim 7, wherein the living hinge includes at least one score line or line of weakness.

9. The container of claim 7, wherein the mating surface is shaped to mate flushly with the first portion of the non-flat presentation surface.

10. The container of claim 7, wherein the two or more stacking feet each include an inwardly extending ridge that snap fits and/or locks with each groove.

11. The container of claim 10, wherein the container is configured to be stable in two positions.

* * * * *